US007138587B2

(12) United States Patent
Nishino et al.

(10) Patent No.: US 7,138,587 B2
(45) Date of Patent: Nov. 21, 2006

(54) KEY SWITCH, KEYBOARD AND KEY-SWITCH ASSEMBLING JIG

(75) Inventors: Takeshi Nishino, Shinagawa (JP); Shuji Nakamura, Shinagawa (JP); Akihiko Takemae, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/169,836

(22) Filed: Jun. 30, 2005

(65) Prior Publication Data

US 2006/0000694 A1 Jan. 5, 2006

(30) Foreign Application Priority Data

Jul. 1, 2004 (JP) ..... 2004-195419
Mar. 31, 2005 (JP) ..... 2005-101887

(51) Int. Cl.
*H01H 9/00* (2006.01)

(52) U.S. Cl. ..... 200/5 A; 200/344; 200/512; 345/156; 400/490

(58) Field of Classification Search ..... 200/5 R, 200/5 A, 341–344, 512, 520, 4; 345/156, 345/153; 400/472, 488, 490
See application file for complete search history.

(56) References Cited

U.S. PATENT DOCUMENTS 5,059,048 A 10/1991 Sirkin
5,758,763 A 6/1998 Sanda et al.
5,767,463 A 6/1998 Gandre
6,004,051 A 12/1999 Hu
6,118,092 A 9/2000 Hayashi
6,140,595 A 10/2000 Yao
6,259,049 B1 * 7/2001 Nakai ..... 200/341
6,417,470 B1 * 7/2002 Kako et al. ..... 200/344
6,586,695 B1 * 7/2003 Sato et al. ..... 200/344
6,812,421 B1 * 11/2004 Sato et al. ..... 200/344
2002/0139652 A1 * 10/2002 Kako et al. ..... 200/344
2003/0188961 A1 10/2003 Obara et al.
2003/0190182 A1 10/2003 Huang

FOREIGN PATENT DOCUMENTS

EP 1 227 509 7/2002
JP 8-234882 9/1996
JP 2000-90769 3/2000
JP 2002-231090 8/2002
JP 2003-31067 1/2003

OTHER PUBLICATIONS

European Search Report, dated Jan. 18, 2006 for related European Patent Application No. 05254013.5-2214.

(Continued)

*Primary Examiner*—Richard K. Lee
(74) *Attorney, Agent, or Firm*—Staas & Halsey LLP

(57) ABSTRACT

A key switch used for a keyboard incorporated as an input device in electronic equipment. The key switch includes a support plate; a key top arranged above the support plate; a pair of link members interlocked to each other to support the key top above the support plate and direct the key top in a vertical direction; and a switch mechanism capable of opening and closing a contact section of an electric circuit in accordance with a vertical movement of the key top. The switch mechanism includes a membrane switch sheet carrying the contact section at a position corresponding to the key top and placed on the support plate. Each of the link members includes a sliding part slidably engaged with the support plate. The membrane switch sheet is provided with a through-hole in a region where the sliding part of each link member is engaged with the support plate, the sliding part of the link member being slidably placed on the support plate through the through-hole in the membrane switch sheet.

12 Claims, 24 Drawing Sheets

OTHER PUBLICATIONS

European Search Report, dated Oct. 10, 2005 for related European Patent Application No. EP 05 25 4013.
Patent Abstract of Japan, Publication No. 2003031067, Publication Date Jan. 31, 2003.
Patent Abstracts of Japan, Publication No. 2000090769, Publication Date Mar. 31, 2000.

* cited by examiner

Fig.26A
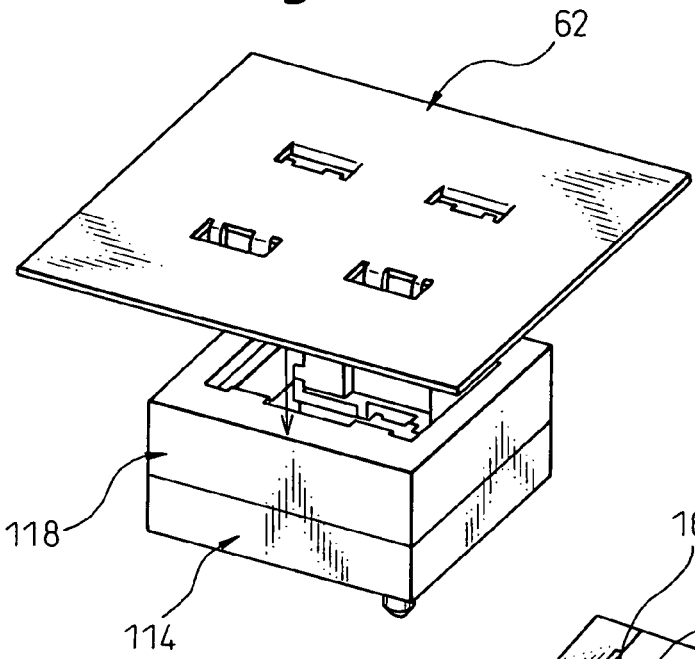
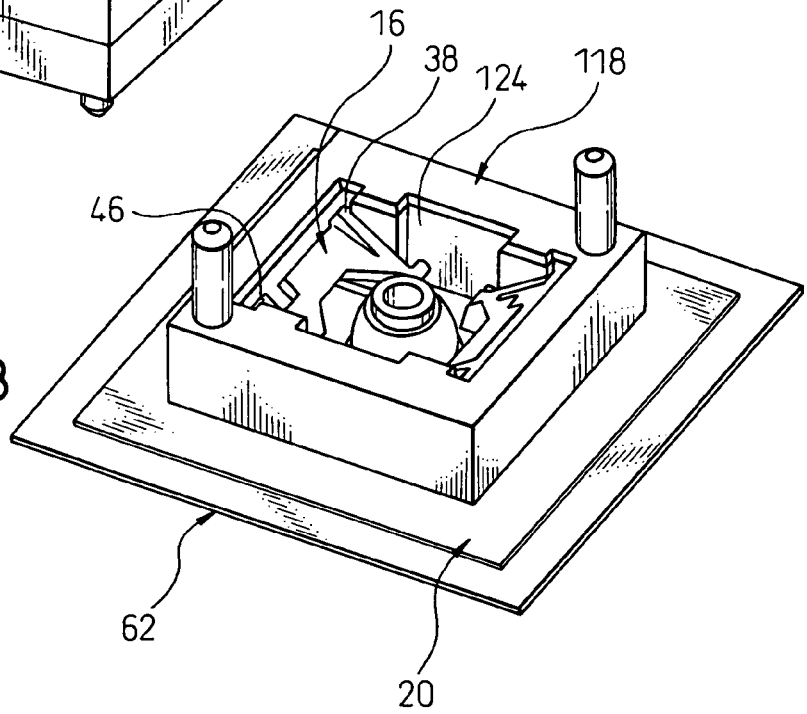
Fig.26B

KEY SWITCH, KEYBOARD AND KEY-SWITCH ASSEMBLING JIG

BACKGROUND OF THE INVENTION

1. Field of the Invention

The present invention relates generally to a switch configuration for key-entry operation and, more particularly, to a key-entry switch device (hereinafter referred to as a key switch) preferably used for a keyboard incorporated, as an input device, in electronic equipment. The present invention also relates to a keyboard provided with a plurality of key switches. The present invention further relates to an assembling jig usable for assembling a key switch.

2. Description of the Related Art

In a thinner or low-profile-type keyboard for a portable electronic apparatus, such as a notebook or palm-top personal computer, it is required to reduce the height of a key switch for a key-entry operation as well as to improve the operability of the key switch. The key switch usable in the low-profile keyboard generally includes a support plate (e.g., a metal sheet, a bottom panel of a keyboard, etc.), a key top arranged above the support plate, a pair of link members interlocked to each other to support the key top above the support plate and direct the key top in a vertical or up-and-down direction, and a switch mechanism capable of opening and closing a contact section of an electronic circuit in accordance with the vertical or up-and-down movement of the key top. The key top is movable substantially in the vertical direction relative to the support plate, through an interlocking action of the link members, while keeping a predetermined posture of the key top. Key-entry operability of the key switch is affected by the amount of stroke (the vertical movement) of the key top and by key-entry operation properties accompanying a so-called "click feeling" during the vertical movement.

Conventionally, in the above key switch, several types of link-member pairs have been used. For example, the first type of link members, which may be referred to as a gear-link type, are assembled together into a reverse V-shape as seen in a lateral direction (or in a side view) and meshed at toothed end regions thereof with each other (see, e.g., Japanese Unexamined Patent Publication (Kokai) No. 2003-031067 (JP-A-2003-031067)). The second type of link members, which may be referred to as a pantograph type, are assembled together into an X-shape as seen in a lateral direction (or in a side view) and are rotatably or slidably joined at the intersections thereof with each other (see, e.g., Japanese Unexamined Patent Publication (Kokai) No. 2002-231090 (JP-A-2002-231090)). Also, a widely-used switching mechanism is configured from the combination of a sheet-like switch including a pair of flexible circuit boards respectively carrying contacts in a mutually facing arrangement (referred to as a membrane switch sheet, in this application), and an actuating member disposed between the key top and the membrane switch sheet and acting in accordance with the downward motion of the key top to close the contacts.

In a key switch disclosed in JP-A-2003-031067, a base panel shaped as a flat frame is disposed on a membrane switch sheet spread and placed on a support plate. Each of a pair of link members combined in the reverse V-shape as seen in a side view is provided at one end thereof with one or more teeth constituting a meshing structure and a pivoting part pivotally joined to the key top, and at another end opposite thereto with a sliding part slidably engaged with a guide section formed in the base panel. During the period when the key top moves in the vertical direction, the link members pivot about the pivoting part in a mutually interlocking manner through the meshing structure, and the respective sliding parts slide along the upper surface of the membrane switch sheet under the guidance of the guide section of the base panel. A dome-shaped actuating member formed of a rubber is used in the switch mechanism. The actuating member is fixed to the membrane switch sheet in the opening of the base panel, with a dome-top thereof facing toward the key top. On the inner surface of the dome-top of the actuating member, a protrusion is formed to be aligned with the contact section of the membrane switch sheet, which acts to press and close the contact section as the key top is lowered. In this key switch, a click feeling in a key-entry operation is ensured by the buckling or elastic deformation of the rubber-made dome-shaped actuating member.

In a key switch disclosed in JP-A-2002-231090, a through-hole is formed in the membrane switch sheet spread and placed on the support plate, so that a guide section and a pivot-support section, provided on the support plate, extend through the through-hole to project from the membrane switch sheet. In the pair of link members combined in the X-shape in a side view, one link member is provided at one end thereof with a pivoting part joined pivotally to the key top and at another end with a sliding part slidably engaged with the guide section of the support plate, while the other link member is provided at one end thereof with a pivoting part pivotally joined to the pivot-support section of the support plate and at another end with a sliding part slidably engaged with the key top. During the period when the key top moves in the vertical direction, the link members pivot in a mutually interlocking manner through a generally center pivoting structure, and the respective sliding parts slide along the key top and the support plate. The link members are also connected together through a return spring shaped in a plate spring, and a plate-spring shaped actuating member separated from the return spring extends from one link member. At the end of the actuating member, a protrusion is formed to be aligned with the contact section of the membrane switch sheet, which acts to press and close the contact section as the key top is lowered. In this key switch, a click feeling in a key-entry operation is ensured by the buckling or elastic deformation of the return spring.

Incidentally, it has been known that a keyboard including a plurality of key switches is configured in such a manner that, in order to improve a key-entry operability of the key tops disposed in a predetermined array on the upper surface of the keyboard housing and to thereby reduce fatigue of an operator, an operator can put his both hands on the keyboard in a natural position where the finger tips of both hands generally converge toward each other and, while maintaining this natural position, can perform a key-entry operation by his finger tips on the top surfaces (i.e., key-operating surfaces) of the respective key tops (see, e.g., Unexamined Japanese Patent Publication (Kokai) No. 8-234882 (JP-A-8-234882)) without sensing any incongruity. The keyboard disclosed in JP-A-8-234882 has a configuration wherein the normal parallel arrangement of the plural key switches is maintained, and wherein the key-operating surfaces of the respective key tops are formed so as to show, in a right-hand key switch group as seen from the operator, a rectangular profile with the right end thereof descending in a plan view, and to shown, in a left-hand key switch group as seen from the operator, a rectangular profile with the left end thereof descending in a plan view. With this configuration, it is possible to prevent the increase in dimension (or occupying area) of the keyboard, in comparison with a configuration in which the respective key switches are arranged obliquely to conform to the natural converging postures of the hands.

The key switch disclosed in JP-A-2003-031067 is configured such that, in the key-entry operation, the gear-link type pair of link members slides at the respective sliding parts along the upper surface of the membrane switch sheet. Therefore, the thicknesses of the support plate and the membrane switch sheet are included in the dimension in the height direction of the key switch. Also, at an instant when the key top reaches the lowermost position of the vertical movement, the link members are disposed to be substantially in contact with the upper surface of the membrane switch sheet at regions between the sliding and pivoting parts thereof, which determines the amount of stroke of the vertical movement. Thus, it is necessary to reduce the thickness of the membrane switch sheet, in countermeasures for height reduction and operability improvement of the key switch. In practice, however, it is considered that the thickness of the membrane switch sheet has been reduced to a physical limit.

In contrast, the key switch disclosed in JP-A-2002-231090 is configured such that, in the key-entry operation, the sliding part of one link member of the pantograph type pair of link members slides, inside the through-hole of the membrane switch sheet, along the guide section of the support plate. Therefore, it is possible to eliminate the influence of the thickness of the membrane switch sheet on the height dimension of the key switch. Also, at an instant when the key top reaches the lowermost position of the vertical movement, the link members are received inside the through-hole of the membrane switch sheet at regions between the sliding and pivoting parts thereof. Therefore, it is also possible to eliminate the influence of thickness of the membrane switch sheet on the amount of stroke of the vertical movement of the key top. Contrary to this, the support plate is also provided with a through-hole at a location corresponding to the through-hole of the membrane switch sheet, so that the link members are supported on the support plate, during the key-entry operation, by only the guide section and the pivot-support section provided locally in the support plate. As a result, the stability of the interlocking movement of the link members (especially, of the sliding motion of the sliding part) may be degraded, and thus the key-entry operability of the key top may be impaired.

On the other hand, in the keyboard disclosed in JP-A-8-234882, the plural key switches are arranged such that the profiles of the key-operating surfaces of the key tops in the right-hand group are generally symmetrical to those in the left-hand group as seen from the operator. Therefore, in order to operate the key switches without sensing incongruity at the finger tips, the operator is required to use both hands in correspondence with the positions of the key switches. This configuration may be difficult, especially for an inexperienced operator. Further, the plural key tops having substantially same size and different shape are used in the above keyboard, so that the assembling process of the keyboard may become complicated and thus may lead to increase in the manufacturing cost.

Further, as the height reduction of the key switch is facilitated, the dimensions, especially of the link members, is decreased. Also, the assembling process of the key switch has often been performed manually, and it becomes difficult to manually assemble the small-sized link members accurately on the support plate, without causing damage or loss of the link members. Thus, it has been required to develop an assembling jig usable in the process for assembling the low-profile key switch.

SUMMARY OF THE INVENTION

It is an object of the present invention to provide a key switch adapted to be subjected to a key-entry operation, which is capable of increasing the amount of stroke of the vertical movement of the key top, and of decreasing the height dimension of the key switch, while ensuring the stable key-entry operability of the key top.

It is another object of the present invention to provide a low-profile keyboard having an excellent operability and including a plurality of key switches as described above.

It is a further object of the present invention to provide a keyboard, as an input device for an electronic apparatus, which has the normal parallel key-arrangement for eliminating the increase of the mounting area, which improves the key-entry operability of the plural key switches to reduce fatigue of the operator, irrespective of the skill of the operator, and which also facilitates assembling process.

It is still another object of the present invention to provide an assembling jig permitting the low-profile key switches to be assembled safely and accurately.

In order to accomplish the above objects, the present invention provides a key switch comprising a support plate; a key top arranged above the support plate; a pair of link members interlocked to each other to support the key top above the support plate and direct the key top in a vertical direction; and a switch mechanism capable of opening and closing a contact section of an electric circuit in accordance with a vertical movement of the key top; wherein the switch mechanism includes a membrane switch sheet carrying the contact section at a position corresponding to the key top and placed on the support plate; wherein each of the pair of link members includes a sliding part slidably engaged with the support plate; and wherein the membrane switch sheet is provided with a through-hole in a region where the sliding part of each link member is engaged with the support plate, the sliding part of the link member being slidably placed on the support plate through the through-hole in the membrane switch sheet.

In the above key switch, each of the pair of link members may include a trunk extending from the sliding part and provided with a recess capable of receiving the membrane switch sheet; and, when the key top is located at a lowermost position of the vertical movement, the sliding part may be in contact with the support plate through the through-hole of the membrane switch sheet and the trunk may be disposed to be superimposed on the membrane switch sheet at the recess.

Also, each of the pair of link members may include an arm extending from the sliding part; and, when the key top is located at a lowermost position of the vertical movement, the sliding part and the arm may be in contact with the support plate through the through-hole of the membrane switch sheet.

The support plate may include a guide section for guiding the sliding part of each of the pair of link members during the vertical movement of the key top, the guide section projecting through the through-hole of the membrane switch sheet upward from the membrane switch sheet.

In this arrangement, the support plate may be formed from a sheet metal material; and the guide section may be integrally formed at a desired location on the support plate by a lancing process.

Alternatively, the support plate may be formed from a resinous material; and the guide section may be integrally molded at a desired location on the support plate.

In this case, the support plate may be formed from an electro-conductive resinous material.

Alternatively, the sliding part of each of the pair of link members may include a pair of sliding axles projecting oppositely to each other; the guide section of the support plate may include two pairs of guide holes individually and slidably receiving the pair of sliding axles of the pair of link members; and each of the pair of link members may further include a slit for permitting the pair of sliding axles to be resiliently displaced toward each other by an amount sufficient for the pair of sliding axles to be fitted into a corresponding pair of the guide holes.

The key switch may further comprise a base panel disposed above the membrane switch sheet; wherein the base panel may include a guide section for guiding the sliding part of each of the pair of link members during the vertical movement of the key top.

The present invention also provides an assembling jig for use in an assembling process of a key switch, comprising an aligning member including a containing section for containing a pair of link members in a predetermined arrangement; a guiding member assembled with the aligning member and including a guiding surface capable of engaging with the pair of sliding axles of each of the pair of link members contained in the containing section; and a pressing member assembled with one of the aligning member and the guiding member and including a pressing section for pressing each of the pair of link members relative to the guiding member in such a manner that the pair of sliding axles of each of the pair of link members are engaged with the guiding surface of the guiding member and are thereby resiliently displaced under pressure toward each other.

The present invention also provides a keyboard comprising a plurality of key switches in a certain arrangement, each of the key switches being as described above.

The present invention also provides a keyboard comprising a plurality of key switches, each key switch including a key top adapted to be subjected to a key-entry operation; and a frame including a front edge defining an operator's side during the key-entry operation and a rear edge opposite to the front edge, the plurality of key switches being arranged in the frame; wherein the key top of each of the plurality of key switches includes an operating surface adapted to be subjected to the key-entry operation and a skirt surface depending from the operating surface along an outer edge of the operating surface, the operating surface being provided with a first profile as a substantially equilateral trapezoid in a plan view, the skirt surface being provided, at its bottom edge away from the operating surface, with a second profile as a substantially rectangular shape in a plan view; and wherein the plurality of key switches are arranged in the frame with the operating surface of the key top of each key switch being disposed in such a manner that a shorter side of generally parallel opposing sides defining the first profile is positioned nearer to the front edge of the frame and a longer side of the opposing sides is positioned nearer to the rear edge of the frame.

BRIEF DESCRIPTION OF THE DRAWINGS

The above and other objects, features and advantages of the present invention will become more apparent from the following description of preferred embodiments in connection with the accompanying drawings, wherein:

FIGS. 26A and 26B are perspective views showing the assembling jig of FIG. 25, and illustrating sequentially the assembling steps after the steps of FIG. 25C;

DESCRIPTION OF THE PREFERRED EMBODIMENT

Figure 1:
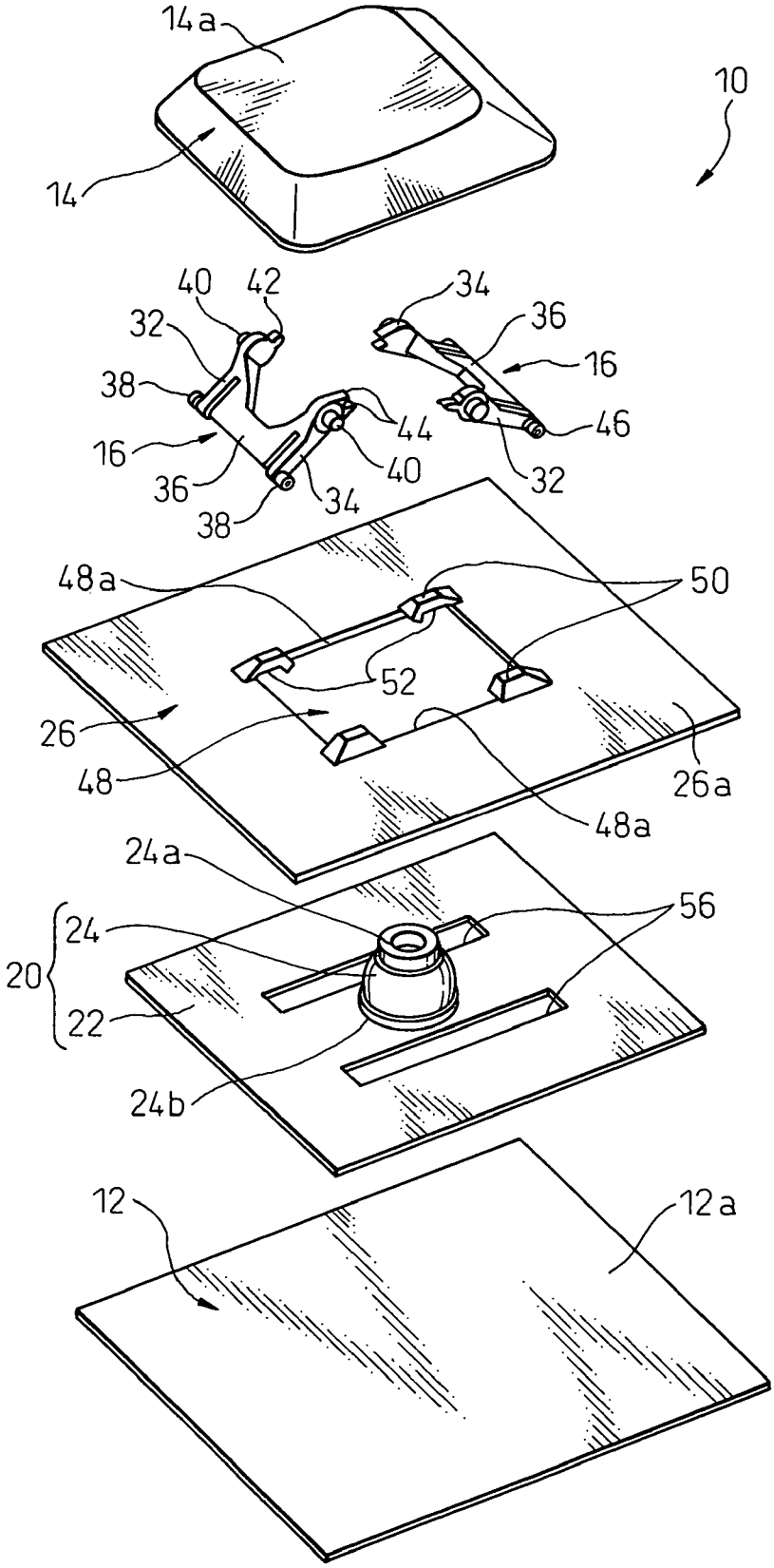
FIG. 1 is an exploded perspective view showing a key switch according to a first embodiment of the present invention.

The embodiments of the present invention are described below in detail, with reference to the accompanying drawings. In the drawings, the same or similar components are denoted by common reference numerals.

Figure 2:
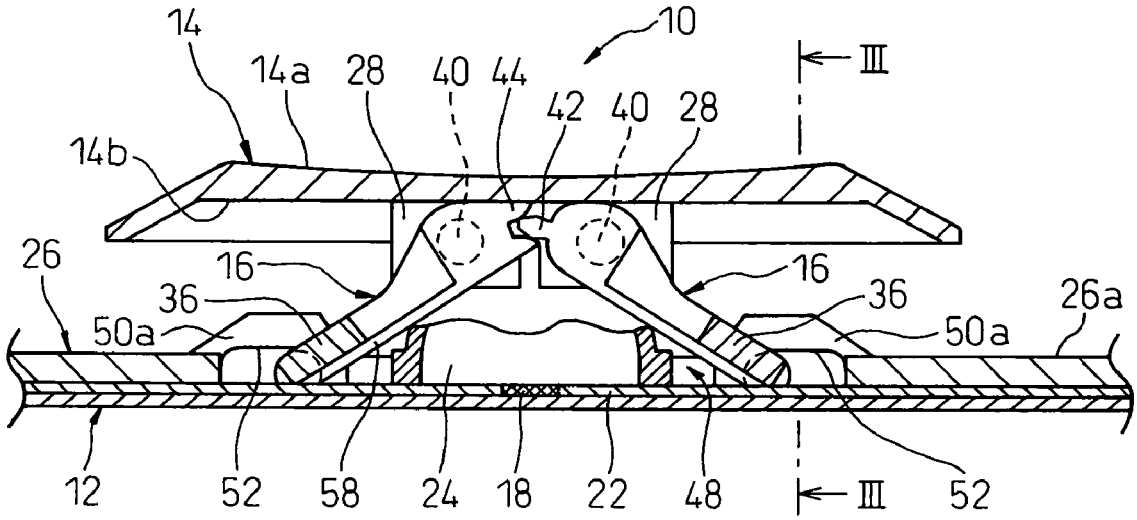
FIG. 2 is a sectional view taken along a line II—II of FIG. 3, showing the key switch of FIG. 1 in an assembled state and at the uppermost position of a keying stroke.
Figure 3:
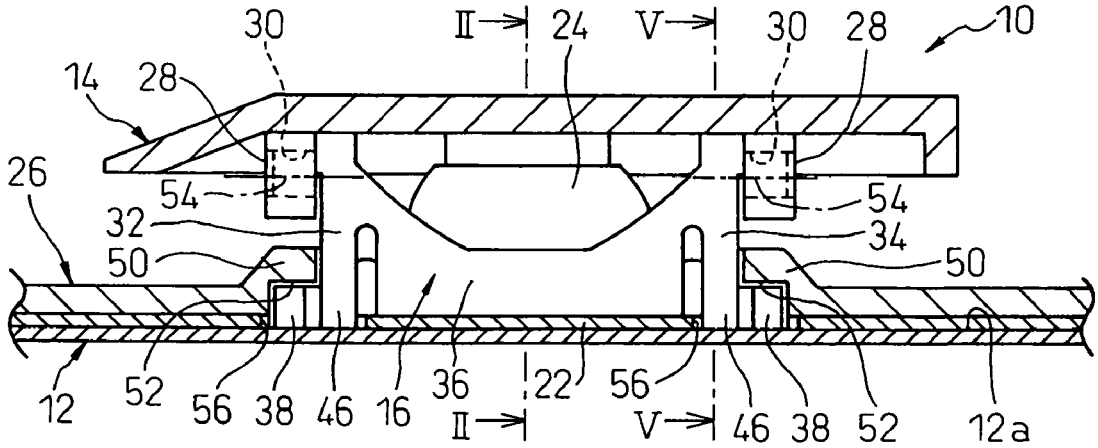
FIG. 3 is a sectional view, in an assembled state, taken along a line III—III of FIG. 2.
Figure 4:
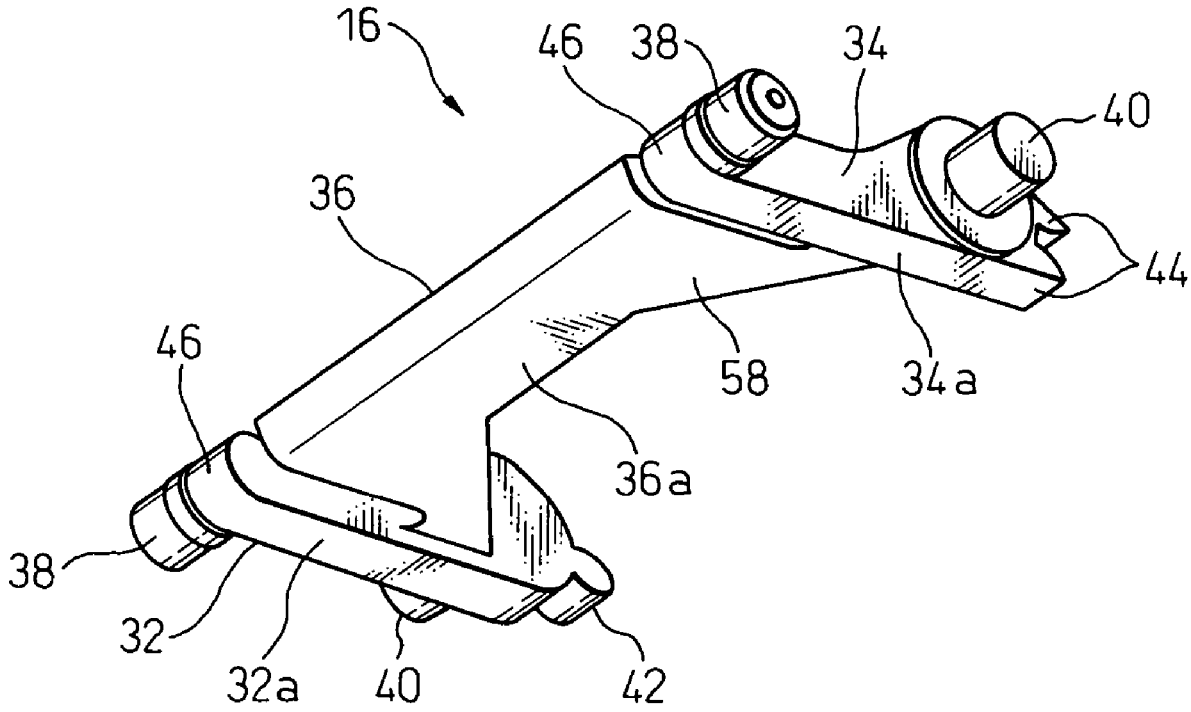
FIG. 4 is an enlarged perspective view showing a link member, from the bottom side thereof, used in the key switch of FIG. 1.

Referring to the drawings, FIG. 1 is an exploded perspective view showing a key switch 10 according to a first embodiment of the present invention, FIGS. 2 and 3 are sectional views showing the assembled key switch 10 in an inoperative state, FIG. 4 is an enlarged perspective view showing one component of the key switch 10, and FIG. 5 is a sectional view showing the assembled key switch 10 in a depressed or operative state.

As shown in FIG. 1, a key switch 10 includes a support plate 12, a key top 14 arranged above the support plate 12, a pair of link members 16 interlocked to each other to support the key top 14 above the support plate 12 and direct the key top 14 in a vertical or up-and-down direction, and a switch mechanism 20 capable of opening and closing a contact section 18 (FIG. 2) of an electric circuit in accordance with the vertical or up-and-down movement of the key top 14. The switch mechanism 20 includes a membrane switch sheet 22 carrying the contact section 18 at a position corresponding to the key top 14 and placed on the support plate 12, and an actuating member 24 disposed between the key top 14 and the membrane switch sheet 22 and acting to close the contact section 18 in accordance with the lowering movement of the key top 14. The key switch 10 further includes a base panel 26 disposed above the membrane switch sheet 22.

The support plate 12 is a rigid member in the shape of a flat plate, such as a separate thin metal plate formed of a sheet metal material, or a resinous lower panel of a keyboard in which the key switch 10 is incorporated. The support plate 12 acts to support, on the generally flat upper surface 12*a* thereof, the membrane switch sheet 22 and the actuating member 24 of the switch mechanism 20 in a stationary state.

The key top 14 is a dish-like member having a generally rectangular shape as seen in a plan view and, e.g., integrally molded into a unitary member from a resinous material, and includes an operating surface 14*a* subjected to a key-entry operation and an inner surface 14*b* opposite to the operating surface 14*a*. As shown in FIG. 2, two pairs of pivot-support sections 28 having a mutually identical structure are formed on the inner surface 14*b* of the key top 14, and are arranged side-by-side in a link sliding direction (a rightward/leftward direction in FIG. 2) as described later. Each pivot-support section 28 is formed of a plate-shaped piece projecting uprightly from the inner surface 14*b* of the key top 14, and a bearing hole 30 is formed therethrough in the direction of plate thickness. Two pivot-support sections 28 constituting each pair are disposed at a generally center region of the inner surface 14*b* of the key top 14 as seen in the link sliding direction, and are spaced from each other by a distance permitting a second end region of each link member 16, as described later, to be inserted therebetween (see FIG. 3). Each of a pair of link members 16 is pivotally joined, at a pivoting part (as described later) provided in the second end region, to the bearing hole 30 of each pivot-support section 28.

A pair of link members 16 have shapes and dimensions identical to each other, and are assembled together into a reverse V-shape as seen in a lateral direction or a side view, and meshed at one end regions thereof with each other in a geared manner. Each link member 16 is formed as, e.g., an integrally molded unitary piece made of a resinous material. The link member 16 integrally includes a pair of arms 32, 34 extending generally parallel to each other and a trunk 36 interconnecting the arms 32, 34 with each other. In the illustrated embodiment, in each of the link members 16, the end regions of the arms 32, 34 adjoining the trunk 36 are defined as a first end region of the link member 16, and the end regions of the arms 32, 34 extending in the same direction from the trunk 36 are defined as a second end region of the link member 16.

In the first end region of each link member 16, a pair of sliding axles 38 constituting a sliding part project coaxially with each other from the mutually facing-away outer sides of the arms 32, 34 and oppositely to the trunk 36. In the second end region of each link member 16, a pair of pivoting axles 40 project coaxially with each other from the outer sides of the arms 32, 34 in the same direction as the sliding axles 38. Further, on one arm 32 of each link member 16, a tooth 42 is provided on the distal end surface of the second end region near the pivoting axis 40, and on the other arm 34, two teeth 44 are provided on the distal end surface of the second end region near the pivoting axis 40. In each link member 16, the end regions (or the first end region) of the arms 32, 34, including the sliding axles 38, constitute a sliding part 46 and are engaged with the support plate 12 and the base panel 26 as will be described later.

The base panel 26 is a flat frame-like member formed from, e.g., an integrally molded unitary piece of resinous material, and includes a generally rectangular opening 48 adapted to be concealed by the key top 14. The base panel 26 is provided at the four corners of the opening 48 with two pairs of guide sections 50 having a mutually identical structure. Each guide section 50 includes a wall portion 50*a* extending from the major surface 26*a* of the base panel 26, internally, into the opening 48 like an overhang, and a guide groove 52 extending generally parallel to the major surface 26*a* along each of a pair of opposing inner edges 48*a* defining the opening 48 is formed inside the wall portion 50*a* (FIG. 2). Two guide sections 50 constituting each pair are spaced apart from each other by a distance permitting the first end region of each link member 16 to be inserted therebetween (FIG. 3). The sliding part 46 of the first end region of the link member 16 is slidably engaged at the sliding axles 38 with the guide grooves 52 of the guide sections 50.

Each of the link members 16 is disposed between the support plate 12 and the key top 14 with, as described above, the sliding axles 38 provided in the first end region slidably fitted into the guide grooves 52 of the respective guide sections 50 of the base panel 26, and with the pivoting axles 40 provided in the second end region pivotally fitted into the bearing holes 30 of the respective pivot-support sections 28 of the key top 14. The pair of link members 16 are configured to be rotatable in a mutually interlocking manner, through an interlocking structure formed by intermeshing one tooth 42 of the respective one arm 32 with two teeth 44 of the respective other arm 34 thereof, about respective pivot axes 54 defined by the pivoting axles 40 of the arms 32, 34 (FIG. 3).

Thus, when the link members 16 synchronously rotate in opposite directions about respective pivot axes 54 and the respective sliding parts 46 slide in a generally horizontal direction under the guiding action of the corresponding guide sections 50 on the base panel 26 (i.e., under the sliding engagement of the sliding axle 38 with the guide groove 52), the key top 14 is subjected to a parallel displacement in a generally vertical direction relative to the base panel 26, while keeping a predetermined, generally-horizontal posture of the key top 14 wherein the operating surface 14*a* is substantially parallel to the major surface 26*a*. More specifically, the uppermost position of the keying stroke (i.e., the stroke of the vertical movement) of the key top 14 is determined at the instant when the sliding motion of the sliding axles 38 of the link members 16 toward each other is stopped by the wall portions 50*a* of the associated guide sections 50 of the base panel 26. As the key top 14 descends from this uppermost position, the sliding parts 46 of the link members 16 slide, under the guiding action of the associated guide sections 50, away from each other in a direction generally perpendicular to the direction of vertical movement of the key top 14. When the key top 14 reaches the lowermost position of the keying stroke, the contact section 18 of the switch mechanism 20 is closed as will be described later.

The membrane switch sheet 22 of the switch mechanism 20 includes a pair of flexible circuit boards respectively carrying contacts to face to each other (not shown), and a sheet-like spacer supporting these circuit boards with a predetermined gap defined therebetween to maintain the contacts in an opened state. The contacts formed on the surfaces of the film substrates of the circuit boards constitute the above-described contact section 18. The membrane switch sheet 22 is spread and placed on the support plate 12 under the base panel 26, and the contact section 18 is positioned generally at the center of the opening 48 of the base panel 26 (FIG. 2).

The actuating member 24 of the switch mechanism 20, which is a dome-shaped member integrally molded into a unitary piece from a rubber material, is disposed in the opening 48 of the base panel 26 with the dome top 24*a* facing toward the key top 14, and is fixed to the membrane switch sheet 22 at the bottom dome-opening end 24*b* thereof. When no load is applied to the actuating member 24, the dome top 24*a* of the actuating member 24 is upwardly spaced from the membrane switch sheet 22. On the inner surface of the dome top 24*a* of the actuating member 24, a protrusion (not shown) is formed to be aligned to the contact section 18 of the membrane switch sheet 22 for pressing and closing the contact section 18 when the key top 14 is depressed.

In the key switch 10, when no external force is applied to the key top 14, the actuating member 24 of the switch mechanism 20 biases the key top 14 toward, and supports it, by the dome top 24*a*, in the uppermost position of the stroke vertically above the base panel 26. At this time, the contact section 18 of the membrane switch sheet 22 is in an opened state. When the key top 14 is depressed by an key-entry operation, the actuating member 24 is deformed while exerting an elastic biasing force to the key top 14 in an upward direction and, just before the key top 14 reaches the lowermost position of the stroke, the actuating member 24 presses the membrane switch sheet 22 from the outside thereof with the protrusion on the inner surface so as to close the contact section 18. When the depressing force upon the key top 14 is released, the actuating member 24 is elastically restored so as to return the key top 14 to the uppermost position and, thereby, the membrane switch sheet 22 is restored to open the contact section 18.

The actuating member 24 is elastically deformed in a buckling mode due to the dome shape thereof, in accordance with a key-entry operation, whereby an elastic biasing force is exerted to the key top 14, which assumes non-linear relationship with a displacement of the key top 14. As a result, the key switch 10 can establish unique key-entry operating properties, accompanied by a so-called click feeling, such that at the instant when the amount of depression of the key top 14 exceeds a predetermined value, the biasing force in a return direction, which has been gradually increased until that time, is sharply reduced.

In the key switch 10, the membrane switch sheet 22 is provided with through-holes 56 at regions corresponding to the two pairs of guide sections 50 of the base panel 26. In the illustrated embodiment, rectangular shaped through-holes 56 are formed, each of which is defined continuously in regions covered by the two guide sections 50 provided along one inner edge 48*a* of the base panel 26 and in a region extending between the guide sections 50. The sliding part 46 of each link member 16 (i.e., portions around the sliding axles 38 of the arms 32, 34) passes through the associated through-holes 56 of the membrane switch sheet 22, and are placed slidably on the upper surface 12*a* of the support plate 12 (FIG. 3). Each link member 16 operates in a sliding manner, over the entire stroke of the vertical movement of the key top 14, and the sliding part 46 passes through the through-hole 56 of the membrane switch sheet 22 and slides along the upper surface 12*a* of the support plate 12. Thus, each through-hole 56 is formed, in the membrane switch sheet 22 along the sliding path of the sliding parts 46 of a pair of link members 16, into dimension and shape so as not to prevent the sliding movement.

Figure 5A:
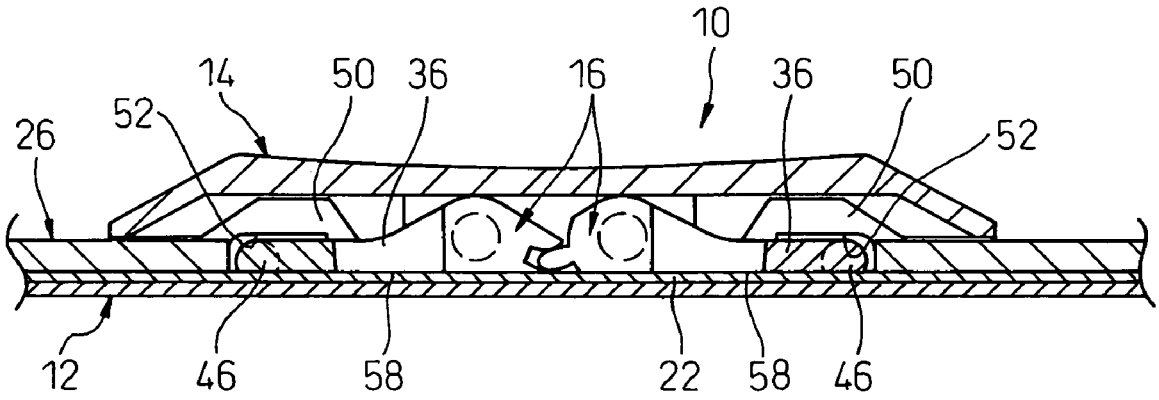
FIG. 5A is a sectional view taken along a line II—II of FIG. 3, showing the key switch of FIG. 1 in an assembled state and at the lowermost position of the keying stroke.

Each link member 16 is provided in its trunk 36 with a recess 58 capable of receiving the membrane switch sheet 22 (FIG. 4). The recess 58 is defined by the lower surface 36*a* of the trunk 36 facing to the membrane switch sheet 22, which is depressed with a step difference at least equal to the thickness of the membrane switch sheet 22 relative to the lower surface 32*a*, 34*a* of the arms 32, 34 also facing to the membrane switch sheet 22. Over the entire stroke of the vertical movement of the key top 14, each link member 16 moves for rotation in a state where the portion extending between the through-holes 56 of the membrane switch sheet 22 is received in the trunk 36. At the instant when the key top 14 reaches the lowermost position of the vertical movement, each link member 16 is disposed such that the trunk 36 extending from the sliding part 46 is superimposed on the membrane switch sheet 22 at the recess 58, while the sliding part 46 is maintained in contact with the support plate 12 through the associated through-holes 56 of the membrane switch sheet 22 (FIG. 5A).

Figure 5B:
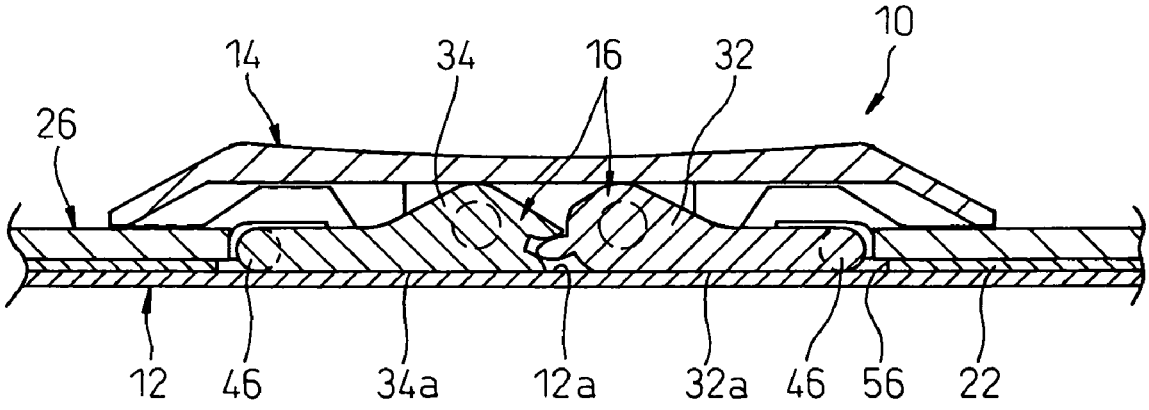
FIG. 5B is a sectional view taken along a line V—V of FIG. 3, showing the key switch of FIG. 1 in an assembled state and at the lowermost position of the keying stroke.

Further, each link member 16 is constructed such that, when the key top 14 reaches the lowermost position of the vertical movement, the sliding part 46 and the arms 32, 34 extending from the sliding part 46 are in contact with the support plate 12 through the associated through-holes 56 of the membrane switch sheet 22. In the illustrated embodiment, each link member 16 is constructed such that, when the key top 14 is in the lowermost position of the vertical movement, the lower surfaces 32*a*, 34*a* of the arms 32, 34 are uniformly in contact with the upper surface 12*a* of the support plate 12 (FIG. 5B).

In the key switch 10 having the above-described configuration, a gear-link type pair of link members 16 are constructed such that, during the key-entry operation, the respective sliding parts 46 pass through the corresponding through-holes 56 of the membrane switch sheet 22 and slide along the upper surface 12*a* of the support plate 12, so that it is possible to eliminate the influence of thickness of the membrane switch sheet 22 on the height dimension of the key switch 10. Therefore, it is possible to increase the amount of stroke of the vertical movement of the key top 14 or to decrease the height dimension of the key switch 10, by an amount equivalent to the thickness of the membrane switch sheet 22, without requiring a further reduction in thickness of the membrane switch sheet 22. More specifically, if the lower profile of the key switch 10 is required, it is possible to reduce the height dimension of the key switch 10 while maintaining the amount of stroke of the vertical movement of the key top 14. On the other hand, if the improvement of keying operability of the key switch 10 is required, it is possible to increase the amount of stroke of the vertical movement of the key top 14 while maintaining the height dimension of the key switch 10. Furthermore, over the entire stroke of the vertical movement of the key top 14, the sliding parts 46 of the link members 16 slide on the upper surface 12*a* of the support plate 12 while being supported thereon, so that it is possible to improve the stability of the interlocking movement of the link members 16 (in particular, the sliding movement of the sliding parts 46), and thus to ensure a stable keying operability.

Further, in the key switch 10, when the key top 14 reaches the lowermost position of the vertical movement, the link members 16 are superimposed on the membrane switch sheet 22 while receiving the membrane switch sheet 22 in the recess 58 formed in the trunks 36, so that it is possible to suppress the stroke of vertical movement of the key top 14 from decreasing due to the abutment of the link members 16 to the membrane switch sheet 22 at portions other than the sliding parts 46. Also, when the key top 14 reaches the lowermost position of the vertical movement, the arms 32, 34 of the respective link members 16 pass through the corresponding through-holes 56 of the membrane switch sheet 22 and come into contact with the upper surface 12*a* of the support plate 12, so that it is possible to surely eliminate the influence of thickness of the membrane switch sheet 22 on the amount of stroke of the vertical movement of the key top 14. The dimensions and shapes of the link member 16 and the actuating member 24 may be suitably set such that the actuating member 24 can stably close the contact section 18 of the membrane switch sheet 22 when the key top 14 reaches the lowermost position of the vertical movement.

FIGS. 6 to 9B show a key switch 60 according to a second embodiment of the present invention. The key switch 60 has a configuration substantially identical to the key switch 10 according to the first embodiment, except that the base plate 26 in the key switch 10 is omitted. Therefore, corresponding components are denoted by common reference numerals, and the explanation thereof is not repeated.

Figure 6:
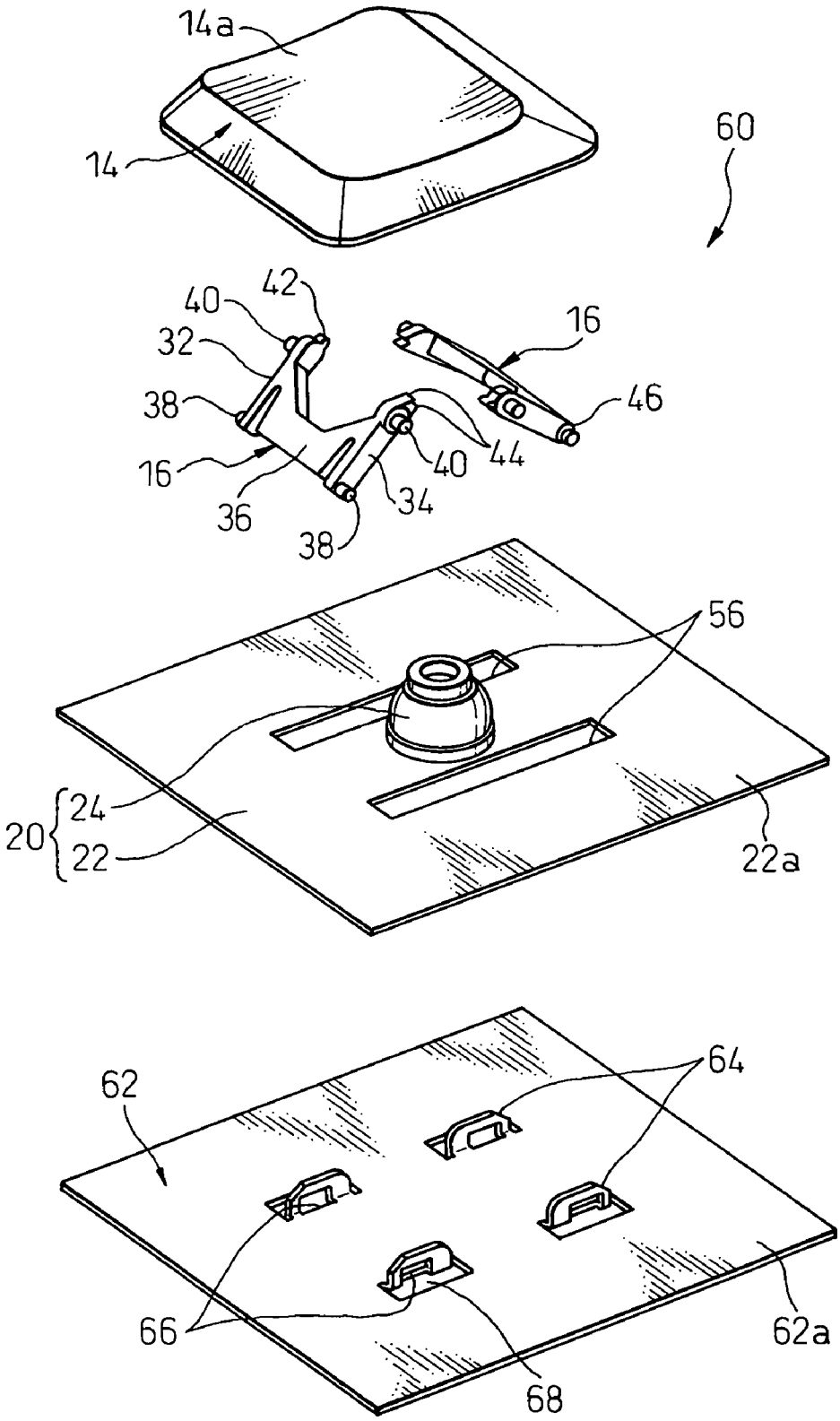
FIG. 6 is an exploded perspective view showing a key switch according to a second embodiment of the present invention.

As shown in FIG. 6, the key switch 60 includes a support plate 62, a key top 14 arranged above the support plate 62, a pair of link members 16 interlocked to each other to support the key top 14 above the support plate 12 and direct the key top 14 in a vertical or up-and-down direction, and a switch mechanism 20 capable of opening and closing a contact section 18 (FIG. 7) of an electric circuit in accordance with the vertical movement of the key top 14. In the key switch 60, the upper surface 22*a* of the membrane switch sheet 22 constituting the switch mechanism 20 is exposed below the key top 14.

The support plate 62 is a rigid member in the shape of a flat plate, like the support plate 12 of the above-described key switch 10, such as a separate thin metal plate formed of a sheet metal material, or a resinous lower panel of a keyboard in which the key switch 60 is incorporated. The support plate 62 supports, on the generally flat upper surface 62*a* thereof, the membrane switch sheet 22 and the actuating member 24 of the switch mechanism 20 in a stationary state. The support plate 62 further includes two pairs of guide sections 64 for respectively guiding the sliding parts 46 of the link members 16 during the vertical movement of the key top 14. These guide sections 64 are plate-like pieces formed by, for example, punching and bending the material of the support plate 62, and are respectively arranged at positions corresponding to the guide sections 50 provided on the base panel 26 of the above-described key switch 10.

Figure 7:
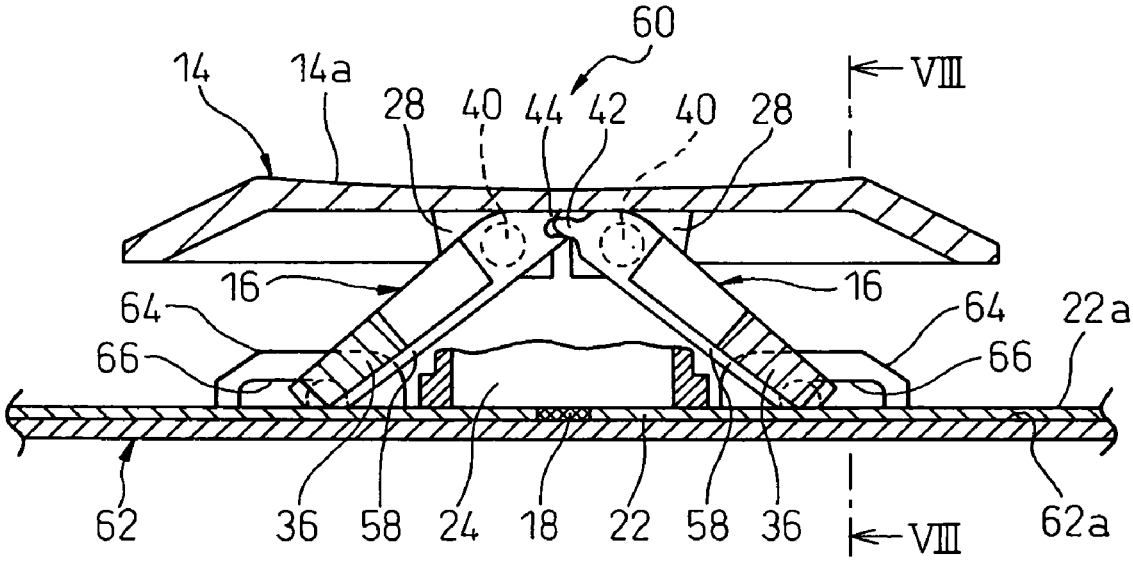
FIG. 7 is a sectional view taken along a line VII—VII of FIG. 8, showing the key switch of FIG. 6 in an assembled state and at the uppermost position of a keying stroke.
Figure 8:
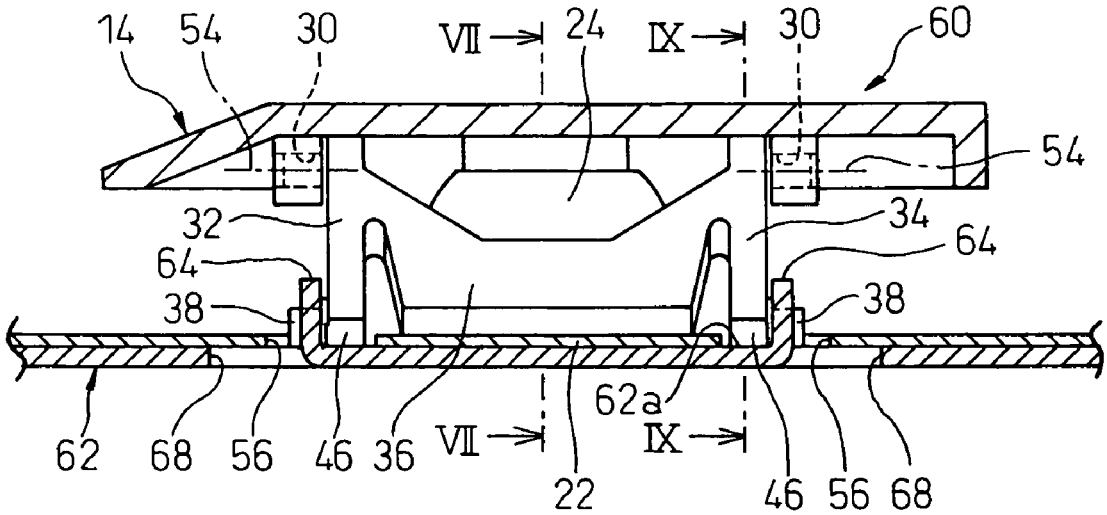
FIG. 8 is a sectional view in an assembled state, taken along a line VIII—VIII of FIG. 7.

A guide hole 66 is formed in each guide section 64 to penetrate therethrough in the direction of plate thickness. The guide hole 66 is shaped as an oblong hole extending generally parallel to the upper surface 62*a* of the support plate 62. Each guide section 64 extends through the corresponding through-hole 56 provided in the membrane switch sheet 22 to project above the membrane switch sheet 22. The guide hole 66 of each guide section 64 is also disposed to be exposed above the upper surface 22*a* of the membrane switch sheet 22 (FIG. 7). Two guide sections 64 forming each pair are spaced apart from each other by a distance permitting a first end region of each link member 16 to be inserted therebetween (FIG. 8). The sliding part 46 at the first region of the link member 16 is slidably engaged by the sliding axles 38 with the guide holes 66 of the guide sections 64. The punched holes 68, formed in the support plate 62 at the instant when the guide sections 64 are formed by punching the material of the support plate 62, are somewhat displaced from the through-holes 56 of the membrane switch sheet 22 (FIG. 8).

Each of the link members 16 is disposed between the support plate 62 and the key top 14 with the sliding axles 38 provided in the first end region slidably fitted into the guide holes 66 of the respective guide sections 64 of the support plate 62, and with the pivoting axles 40 provided in the second end region pivotally fitted into the bearing holes 30 of the respective pivot-support sections 28 of the key top 14. The pair of link members 16 are configured to be rotatable in a mutually interlocking manner, through an interlocking structure formed by intermeshing one tooth 42 of the respective one arm 32 with two teeth 44 of the respective other arm 34, about respective pivot axes 54 defined by the pivoting axles 40 of the arms 32, 34 (FIG. 8). As shown in the drawings, the link member 16 of the key switch 60 has a somewhat thinner profile as compared to the link member 16 of the above-described key switch 10.

When the link members 16 synchronously rotate in opposite directions about respective pivot axes 54 and the respective sliding parts 46 slide in a generally horizontal direction under the guiding action of the corresponding guide sections 64 on the support plate 62 (i.e., under the sliding engagement of the sliding axle 38 with the guide hole 66), the key top 14 is subjected to a parallel displacement in a generally vertical direction relative to the support plate 62, while keeping a predetermined, generally-horizontal posture of the key top 14 wherein the operating surface 14*a* is substantially parallel to the upper surface 22*a* of the membrane switch sheet 22. More specifically, the uppermost position of the keying stroke (i.e., the stroke of the vertical movement) of the key top 14 is determined at the instant when the sliding motion of the sliding axles 38 of the link members 16 toward each other is stopped by the edges of the guide holes 66 of the associated guide sections 64 of the support plate 62. As the key top 14 descends from this uppermost position, the sliding parts 46 of the link members 16 slide, under the guiding action of the associated guide sections 64, away from each other in a direction generally perpendicular to the direction of vertical movement of the key top 14. When the key top 14 reaches the lowermost position of the keying stroke, the contact section 18 of the switch mechanism 20 is closed by the actuating member 24.

In the key switch 60, the sliding part 46 of each link member 16 (i.e., portions around the sliding axles 38 of the arms 32, 34) passes through the associated through-holes 56 of the membrane switch sheet 22, and are placed slidably on the upper surface 62*a* of the support plate 62 inside a pair of guide sections 64 (FIG. 8). The sliding part 46 of each link member 16 extends through the through-holes 56 of the membrane switch sheet 22, and slides along the upper surface 62*a* of the support plate 62, over the entire stroke of the vertical movement of the key top 14.

Figure 9A:
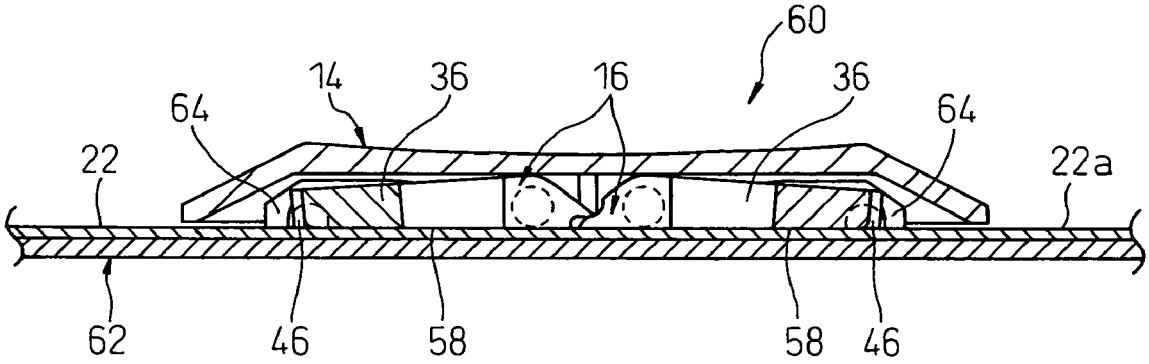
FIG. 9A is a sectional view taken along a line VII—VII of FIG. 8, showing the key switch of FIG. 6 in an assembled state and at the lowermost position of the keying stroke.

Also, over the entire stroke of the vertical movement of the key top 14, each link member 16 moves for rotation in a state where the portion extending between the through-holes 56 of the membrane switch sheet 22 is received in the trunk 36. At the instant when the key top 14 reaches the lowermost position of the vertical movement, each link member 16 is disposed such that the trunk 36 extending from the sliding part 46 is superimposed on the membrane switch sheet 22 at the recess 58, while the sliding part 46 is maintained in contact with the support plate 62 through the corresponding through-holes 56 of the membrane switch sheet 22 (FIG. 9A).

Figure 9B:
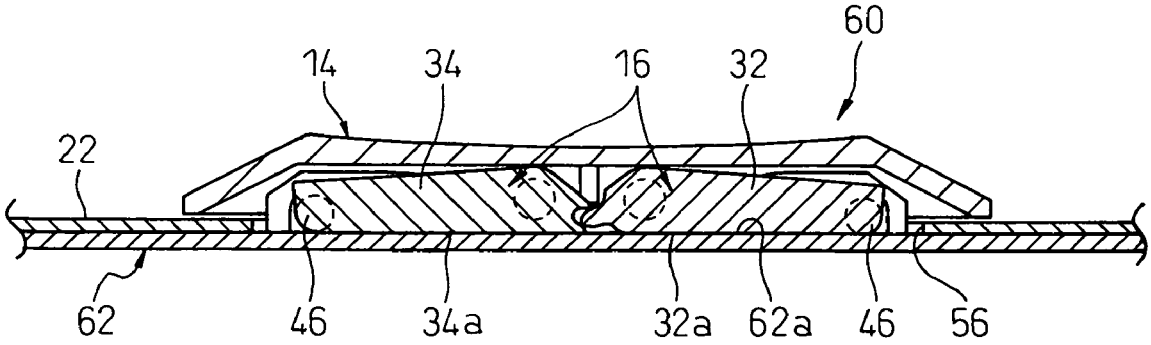
FIG. 9B is a sectional view taken along a line IX—IX of FIG. 8, showing the key switch of FIG. 6 in an assembled state and at the lowermost position of the keying stroke.

Further, each link member 16 is constructed such that, when the key top 14 reaches the lowermost position of the vertical movement, the sliding parts 46 and the arms 32, 34 extending from the sliding parts 46 are in contact with the support plate 62 through the associated through-holes 56 of the membrane switch sheet 22. In the illustrated embodiment, each link member 16 is constructed such that, when the key top 14 is in the lowermost position of the vertical movement, the lower surface 32*a*, 34*a* of the arms 32, 34 are uniformly in contact with the upper surface 62*a* of the support plate 62 (FIG. 9B).

In the key switch 60 having the above-described configuration, the same operative effect can be obtained as in the above-described key switch 10. In particular, the base panel 26 is omitted in the key switch 60, so that it is possible to reduce the weight and the number of components in the key switch 60. Also, by using the thinner link members 16 as illustrated, it is possible to increase the amount of stroke of the vertical movement of the key top 14. Alternatively, when the link member 16 used in the key switch 60 has a configuration identical to that in the above-described key switch 10, it is possible to increase the height dimension of the key top 14 by the amount equal to the thickness of the base panel 26. In this case, in spite of the low height of the key switch 60, it is possible to ensure the stable feeling of key-entry operation, which is similar to that in a deep-dish type key top used in a key switch having a normal height.

Figure 10:
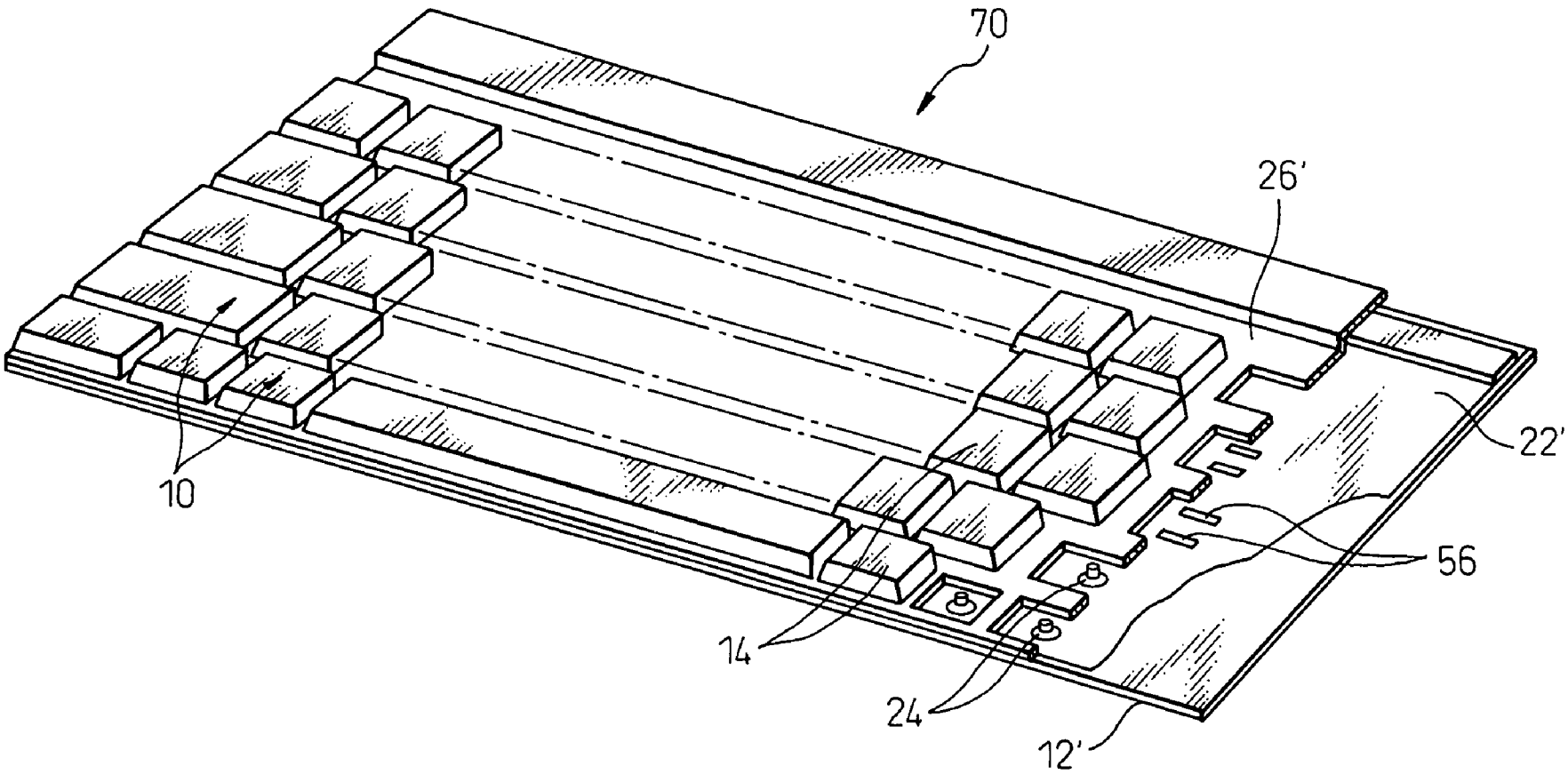
FIG. 10 is a partially cutaway perspective view showing a keyboard according to an embodiment of the present invention, including the key switch of FIG. 1.

FIG. 10 schematically shows a keyboard 70 according to an embodiment of the present invention, in which a plurality of key switches 10, each according to the above-described first embodiment, are disposed in a predetermined arrangement. The keyboard 70 has a low profile structure permitting it to be used as an input device for a portable electronic apparatus, such as a notebook type or a palm-top type personal computer. In the keyboard 70, the support plate 12, the membrane switch sheet 22 and the base panel 26 in the above-described key switch 10 are respectively formed as a large-sized support plate 12', a large-sized membrane switch sheet 22' and a large-sized base panel 26' and are common to all key switches 10 incorporated in the keyboard 70. The membrane switch sheet 22' is provided with respective pairs of through-holes 56 at positions corresponding to the key tops 14 of the respective key switches 10. The keyboard 70 having the above configuration is excellent in operability in spite of a low profile type.

Figure 11:
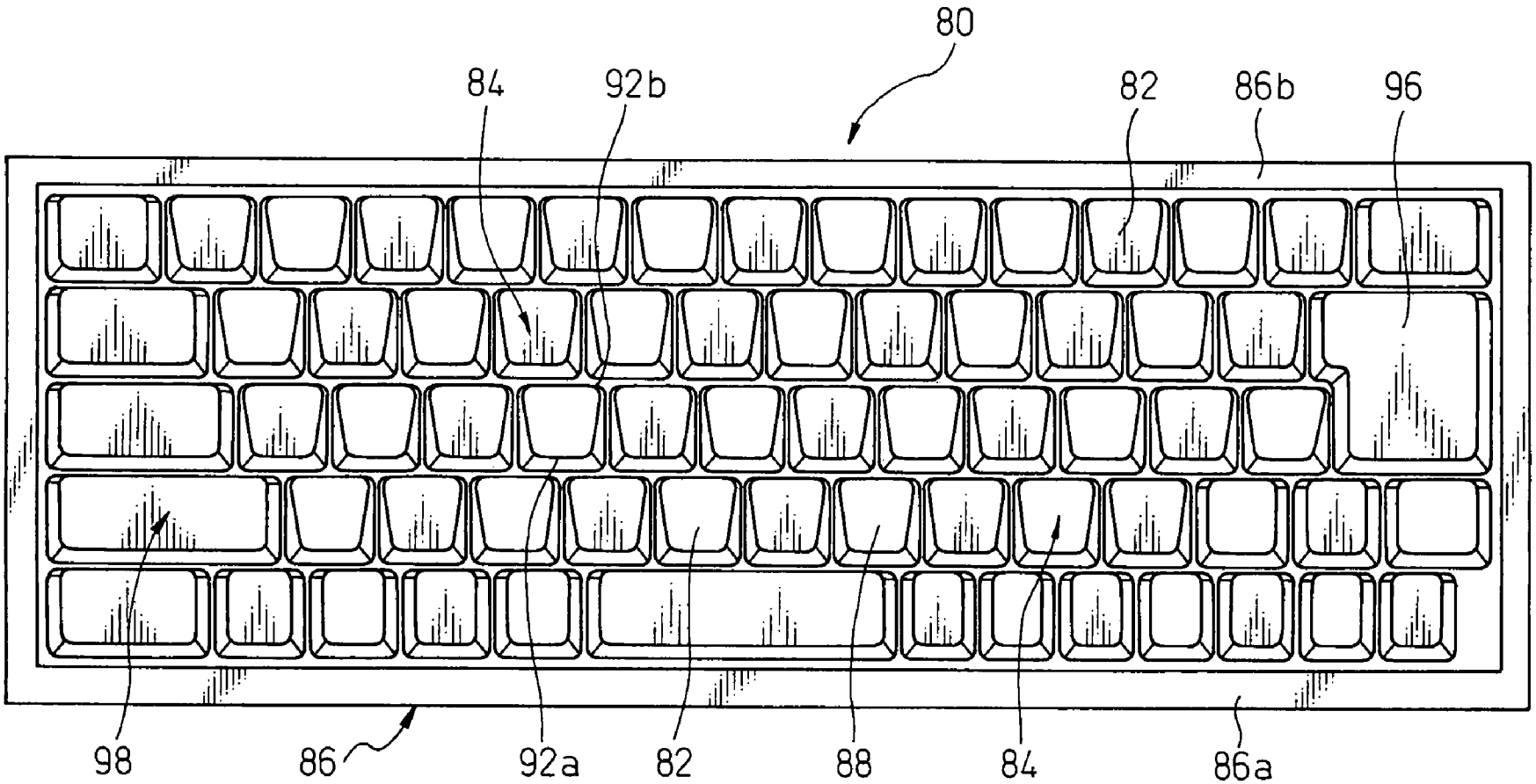
FIG. 11 is a plan view showing a keyboard according to another embodiment of the present invention.

FIG. 11 shows a keyboard 80 according to another embodiment of the present invention, which has a novel structure for improving the keying operability of a plurality of key tops disposed in predetermined arrangement on an upper surface of a housing and thereby reducing fatigue of an operator. The keyboard 80 includes a plurality of key switches 84, each key switch 84 including a key top 82 adapted to be subjected to a key-entry operation, and a frame 86 including a front edge 86*a* defining an operator's side during the key-entry operation and a rear edge 86*b* opposite to the front edge 86*a*, the plural key switches 84 being arranged in the frame 86. As illustrated, the plural key switches 84 are arranged in accordance with a conventional side-by-side arrangement, and thus the frame 86 exhibits a rectangular shape in a plan view, which significantly eliminates an idle space between the adjacent key switches 84.

Figure 12:
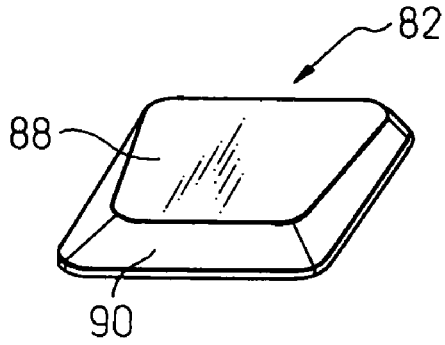
FIG. 12 is a perspective view showing a key top used in the keyboard of FIG. 11.
Figure 13C:
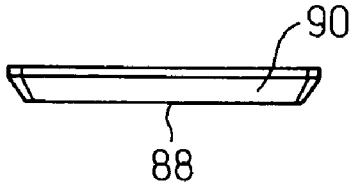
FIGS. 13A to 13D are a plan view, a front elevation, a right side view and a rear elevation, respectively, showing the key top of FIG. 12.
Figure 13D:
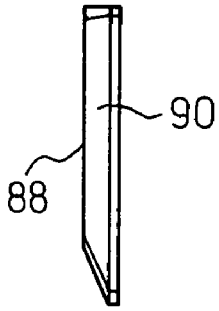
Figure 13A:
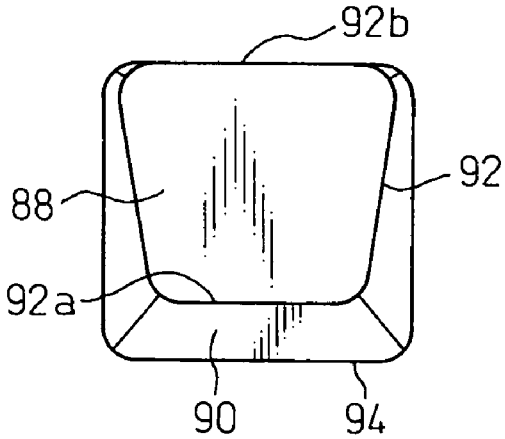
Figure 13B:
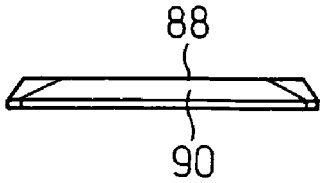

As shown by enlarged views in FIGS. 12 to 13D, the key top 82 of each key switch 84 includes an operating surface 88 adapted to be subjected to the key-entry operation and a skirt surface 90 depending from the operating surface 88 along the outer edge of the operating surface 88. The operating surface 88 is a flat surface (FIGS. 13B to 13D), and is provided with a first profile 92 as a substantially equilateral trapezoid as seen in a plan view in a vertical direction (FIG. 13A). The skirt surface 90 extends, with a suitable angle defined relative to the operating surface 88, along the entire outer circumferential edge defining the first profile 92 of the operating surface 88. The skirt surface 90 is provided, at its bottom edge away from the operating surface 88, with a second profile 94 as a substantially rectangular shape in a plan view identical to the plan view specifying the first profile 92 (FIG. 13A).

As shown in FIG. 11, the plural key switches 84 are arranged in the frame 86 with the operating surface 88 of each key top 82 being disposed in such a manner that a shorter side 92*a* of generally parallel opposing sides 92*a*,

92*b* defining the first profile 92 (FIG. 13A) is positioned nearer to the front edge 96*a* of the frame 86 and the longer side 92*b* of the opposing sides 92*a*, 92*b* is positioned nearer to the rear edge 86*b* of the frame 86. In the keyboard 80, in addition to the key switches 84 including the key tops 82 having the above characteristic shapes, key switches 98 including key tops 96 having conventional normal shapes (i.e., in each key top, a first profile of an operating surface is substantially similar to a second profile of a skirt surface) are provided in a suitable arrangement. More specifically, the key switch 84 including the key top 82 having the above-described characteristic shape is used for keys representing frequently used characters or symbols, while conventional key switch 98 is used for infrequently used functional keys.

In the keyboard 80 having the above-described configuration, the key top 82 of the individual key switch 84 includes the operating surface 88 formed such that the width thereof increases gradually and symmetrically from a near side to a far side, as seen from an operator during the key-entry operation. As a result, the operator can perform the key-entry operation on the operating surface 88 of the individual key top 84 with his both hands put in a natural position where the finger tips of both hands generally converge toward each other, without sensing incongruity at the finger tips (i.e., hardly sensing, by touch, the outer edge of the operating surface 88). Further, the shapes of the key tops 82 are not distinguished for right-hand and left-hand uses, and thus the plural key switches 84 having the key tops 82 of identical shape are used, so that it is possible to eliminate the requirement for an operator to select either hand depending upon the location of the key switch 84 and, therefore, it is possible to easily operate the keyboard 80 even for an operator having little skill. Further, the plural key tops 82 have identical shapes, so that it is possible to facilitate the assembling process of the keyboard 80, and thus to effectively suppress the increase in manufacturing cost.

Also, the second profile 94 of the skirt surface 90 of the key top 82 in each of the plural key switches 84 is the rectangular shape, so that it is possible to minimize gaps between the adjoining key tops 82 even in the illustrated normal side-by-side arrangement, and thus to prevent foreign matter from penetrating into the interior of the key switch 84. Further, the plural key switches 84 are arranged in the normal side-by-side arrangement, so that it is possible to suppress the increase in the outer dimension of the keyboard 80, and thus to effectively reduce an area required for placing the keyboard.

Figure 14:
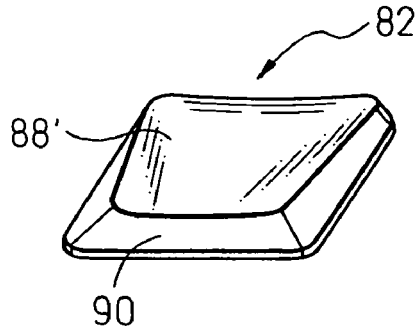
FIG. 14 is a perspective view showing a modification of the key top.
Figure 15C:
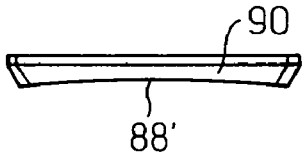
FIGS. 15A to 15D are a plan view, a front elevation, a right side view and a rear elevation, respectively, showing the key top of FIG. 14.
Figure 15D:
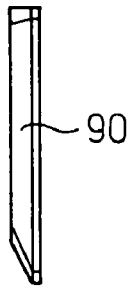
Figure 15A:
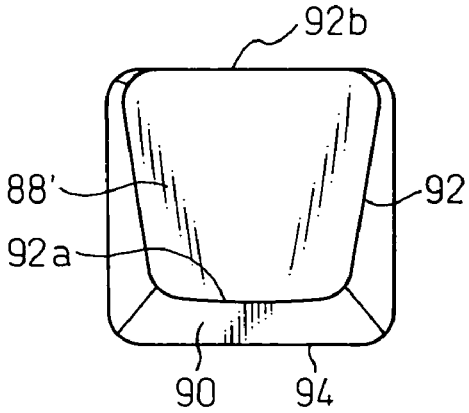
Figure 15B:
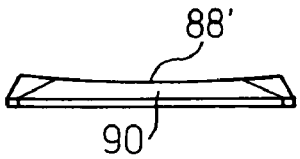
Figure 16:
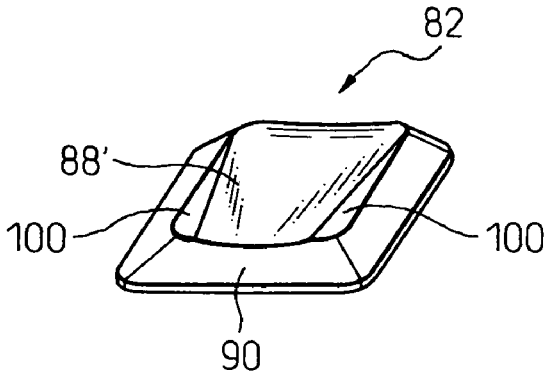
FIG. 16 is a perspective view showing another modification of the key top.
Figure 17C:
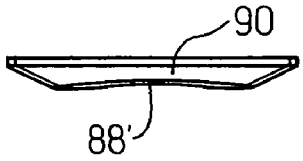
FIGS. 17A to 17D are a plan view, a front elevation, a right side view and a rear elevation, respectively, showing the key top of FIG. 16.
Figure 17A:
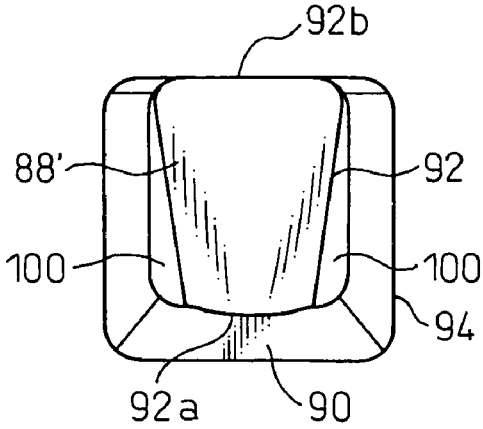
Figure 17D:
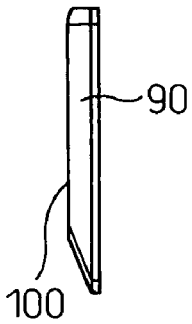
Figure 17B:
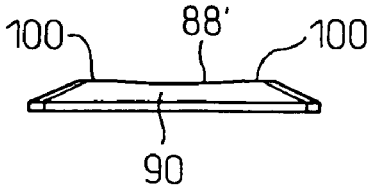
Figure 18:
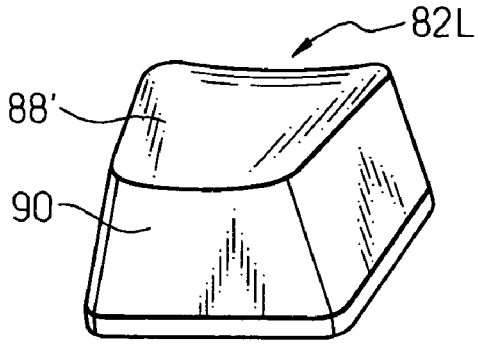
FIG. 18 is a perspective view showing a further modification of the key top.
Figure 19C:
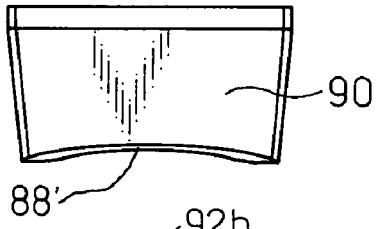
FIGS. 19A to 19D are a plan view, a front elevation, a right side view and a rear elevation, respectively, showing the key top of FIG. 18.
Figure 19D:
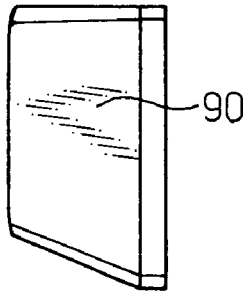
Figure 19A:
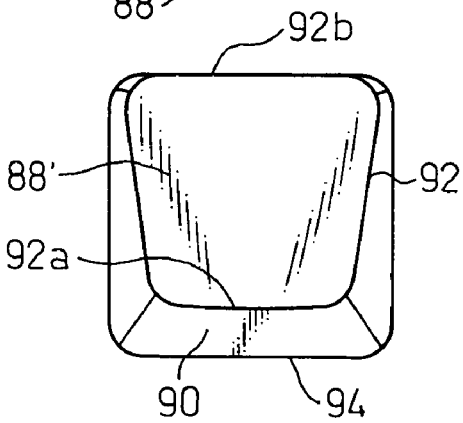
Figure 19B:
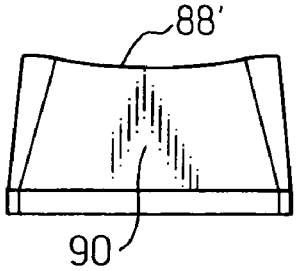
Figure 20:
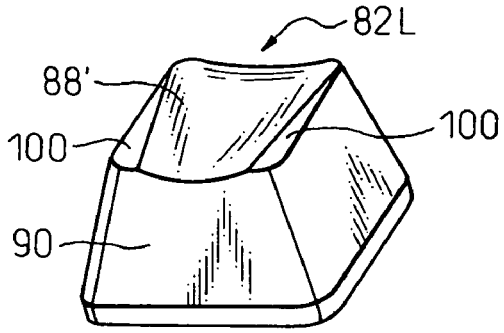
FIG. 20 is a perspective view showing a yet further modification of the key top.
Figure 21C:
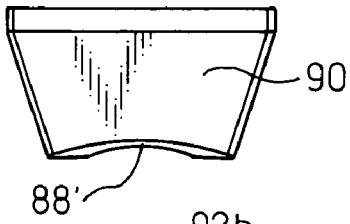
FIGS. 21A to 21D are a plan view, a front elevation, a right side view and a rear elevation, respectively, showing the key top of FIG. 20.
Figure 21D:
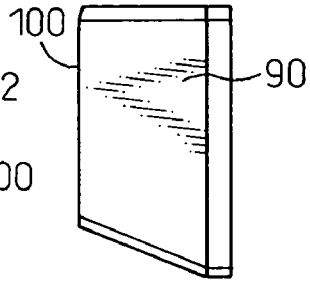
Figure 21A:
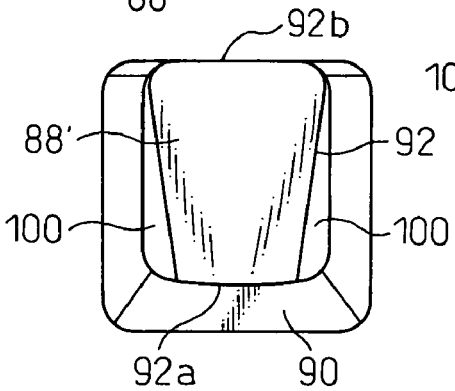
Figure 21B:
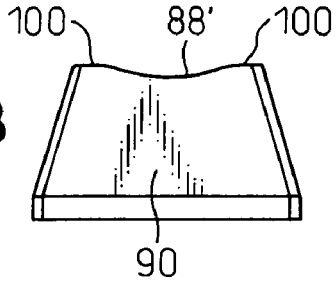

FIGS. 14 to 21D show various modifications of the key top 82 having the above-described characteristic shape. As shown in FIGS. 14 to 15D, the operating surface 88 of the key top 82 may be formed as a concave surface 88' adaptable to the convex shape of the thickness of a finger tip. With this configuration, the feeling of the operating surface 88 can be further improved. Also, as shown in FIGS. 16 to 17D, in addition to the configuration wherein the operating surface 88 of the key top 82 is formed as the concave surface 88*a* adaptable to the convex shape of the thick of the finger tip, generally flat extension surfaces 100 may be formed around the operating surface 88, so as to exhibit an external appearance as if the operating surface 88 has a conventional rectangular profile. Various configurations of the key tops 82 as described above are not limitedly applied to the illustrated key tops suitably used for the low-profile key switches 84 and keyboards 80, but also can be applied to the key tops suitably used for key switches and keyboards having normal heights provided for, e.g., so-called desk-top personal computers. FIGS. 18 to 19D show a key top 82L having a normal height, the configuration of which corresponds to the low-profile key top 82 as shown in FIGS. 14 to 15D. Also, FIGS. 20 to 21D show a key top 82L having a normal height, the configuration of which corresponds to the low-profile key top 82 as shown in FIGS. 16 to 17D.

Incidentally, the key switch 60 according to the second embodiment of the present invention and described with reference to FIGS. 6 to 9B has an exemplary configuration in which the support plate 62 is formed of a sheet metal material. In this configuration, two pairs of guide sections 64 are formed integrally with the remaining portion of the support plate 62 at desired locations on the support plate 62, preferably by a lancing process (or a punching and bending process) using a press machine. This configuration is advantageous in a point that sufficient rigidity can be ensured even with a thin support plate 62.

The support plate 62 is preferably formed from aluminum or magnesium alloy in order to reduce the weight of the key switch 60. Magnesium alloy is particularly suitable as the material for the support plate 62 of the key switch 60 because of its light weight and high rigidity. Due to its high rigidity, however, magnesium alloy tends to be difficult to use in forming the guide sections 64 accurately by the lancing process.

Figure 22:
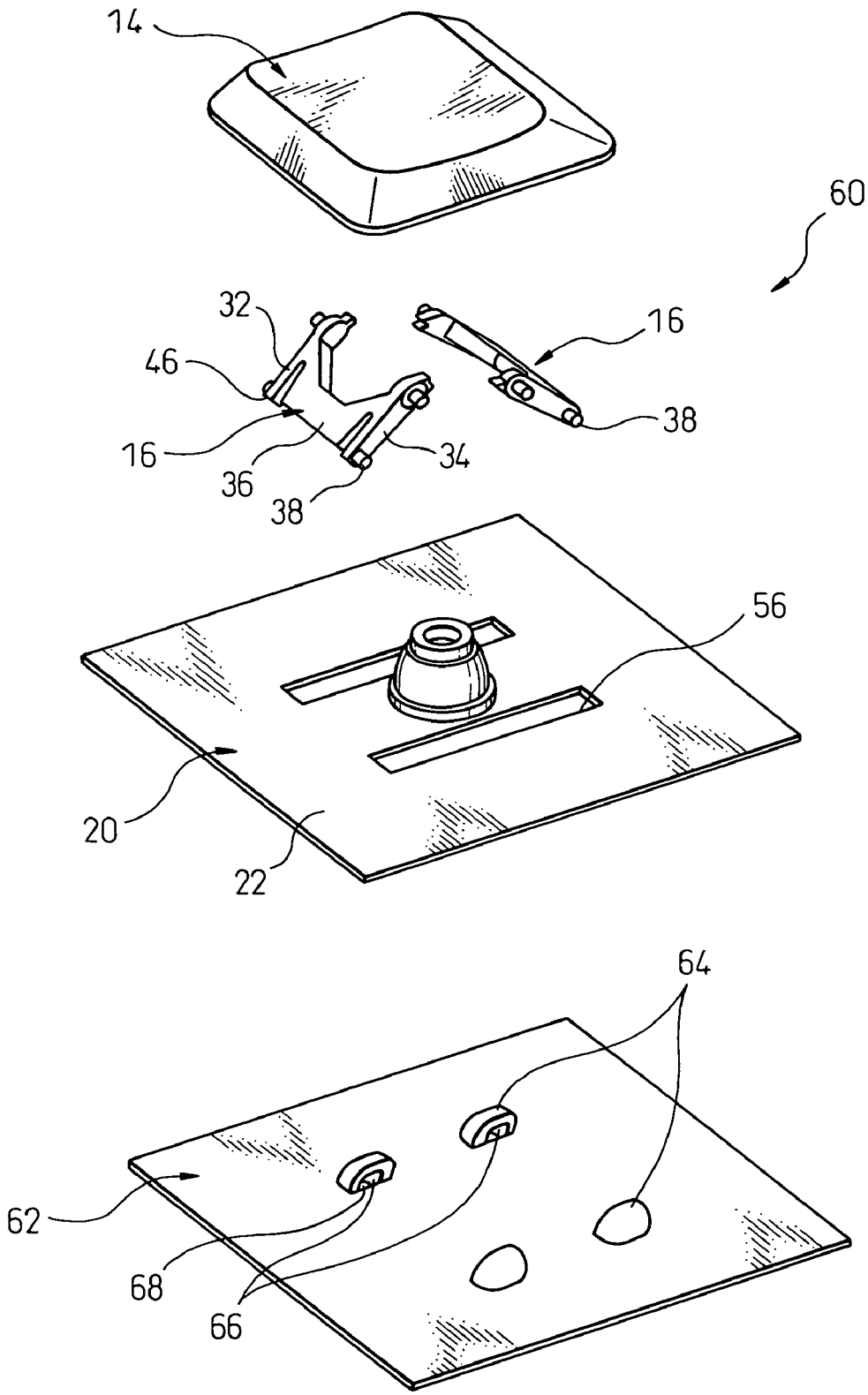
FIG. 22 is an exploded perspective view showing a modification of the key switch of FIG. 6.

Therefore, as a modification of the key switch 60, a configuration as shown in FIG. 22 may be adopted in which the support plate 62 is formed from a resinous material and two pairs of guide sections 64 are molded integrally with the remaining portion of the support plate 62 at the desired locations on the support plate 62 by, e.g., an injection molding process. In this case, the guide hole 66 in the shape of a groove or a through-hole is formed in each guide section 64 on the support plate 62 into a predetermined shape using a predetermined molding surface of a mold (not shown). With this configuration, it is possible to establish the required weight reduction while ensuring the required strength of the support plate 62 by freely and suitably selecting the resinous material, and to form the plural guide sections 64 respectively including the guide holes 66 in a high precision.

Figure 23:
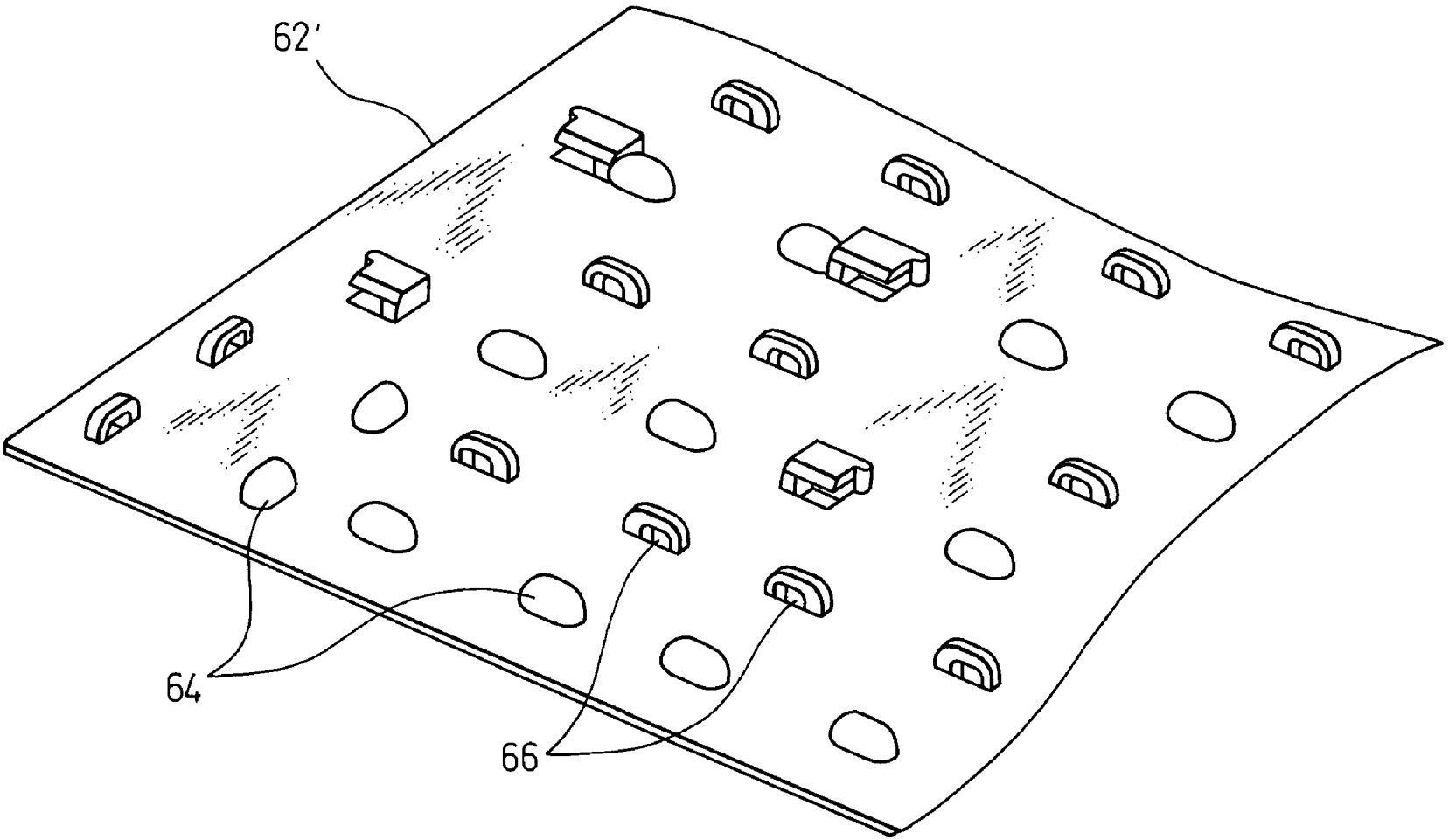
FIG. 23 is a partially enlarged perspective view showing a large-sized support plate used in a keyboard including the key switch of FIG. 6.

In a keyboard configured by arranging a plurality of key switches 60, each of which being the above-described key switch 60, as shown in FIG. 23, a large size support plate 62' common to all key switches 60 can be integrally molded into a unitary member from a resinous material by, e.g., an injection molding process. With this configuration, it is possible to easily and accurately form a multiplicity of guide sections 64 at predetermined locations on the support plate 62'. Further, it is possible to form components (not shown) required to construct a keyboard (e.g., bolts, nuts, fittings, etc., for fixing the support plate 62' to a not-shown housing) integrally on the support plate 62' in the same process for forming the guide sections 64.

Alternatively, it is possible to provide general metal bolts or nuts on the support plate 62' by means of caulking, bonding, integral (insert or outsert) molding, etc., as the components required to construct a keyboard. In the same manner, a metal plate (not shown) for heat radiation or anti-electrostatic measures can also be provided on the support plate 62'. When an electro-conductive resinous material containing electro-conductive filler is adopted as the material of the support plate 62' and the support plate 62' is connected to a ground potential, it is possible to additionally provide the function of electromagnetic shielding to the support plate 62'. This configuration is particularly effective in a personal computer incorporating the keyboard in a common housing (e.g., a notebook type PC).

As shown in FIG. 22, when the support plate 62 is integrally molded from a resinous material by an injection molding process or the like, an extraction hole 68 for extracting a mold is formed in communication with the guide hole 66 of each guide section 64. The extraction hole 68 is disposed to be generally aligned with the corresponding through-hole 56 of the membrane switch sheet 22. Therefore, especially when a keyboard is to be constructed, it is advantageous to dispose a not-shown water and/or dust-proof sheet (e.g., a PET (polyethylene terephthalate) film) under the large size support plate 62'.

The key switch 60 according to the above-described second embodiment of the present invention is configured such that the base panel 26 in the key switch 10 according to the first embodiment (FIG. 1) is omitted and the guide sections 64 for guiding the sliding parts 46 of the link members 16 are provided on the support plate 62. Therefore, in contrast to the assembling process of the key switch 10, in which the link member 16 is put between the support plate 12 and the base panel 26 and thereby each sliding axle 38 is inserted into the corresponding guide groove 52 of the guide section 50 (FIG. 1), the assembling process of the key switch 60 requires that the sliding axle 38 of each link member 16 is forcibly fitted into the corresponding guide hole 66 of the guide section 64.

Figure 24A:
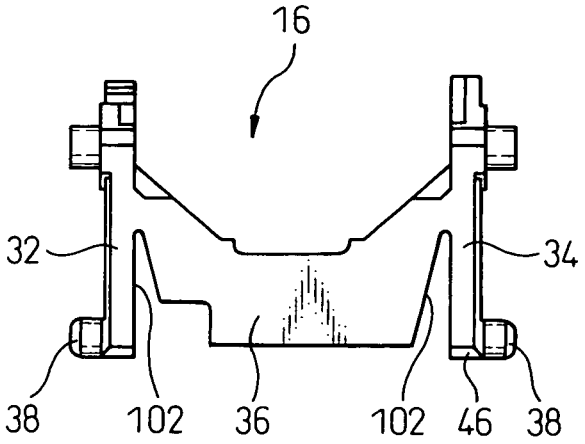
FIG. 24A is a plan view showing a link member in a normal state, which is used in the key switch of FIG. 6.
Figure 24B:
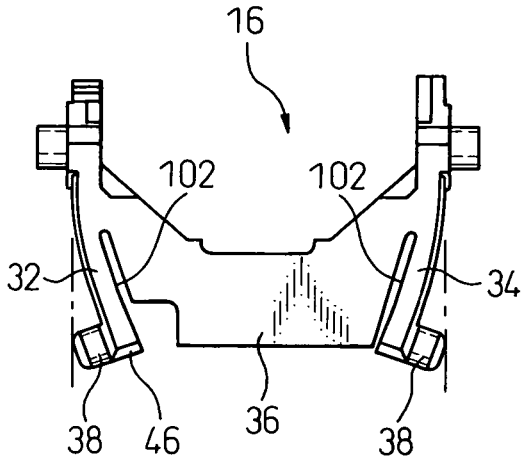
FIG. 24B is a plan view showing the link member in a state where the arms thereof are elastically deformed.

Therefore, as shown in FIG. 24, each link member 16 in the key switch 60 is provided, between the trunk 36 and the sliding part 46 including a pair of sliding axles 38, with a pair of slits 102 permitting a rocking motion of the arms 32, 34 due to the elastic deformation thereof relative to the trunk 36. The slits 102 have predetermined dimensions and shapes, suitable for permitting a pair of sliding axles 38 of the link member 16 to be elastically displaced toward each other by an amount sufficient for the sliding axles 38 to be fitted into the corresponding guide holes 66 of the guide section 64 on the support plate 62 (see FIGS. 24A and 24B).

In this connection, the key switch 10 shown in FIG. 1 also provided in each link member 16 with similar slits between the arms 32, 34 and the trunk 36. However, these slits are not provided for fitting the sliding axles 38 of the link member 16 into the guide grooves 52 of the guide sections 50, but have a function of eliminating fluctuation of the sliding part 46 of the link member 16 by maintaining the slightly elastically deformed state of the arms 32, 34 during the period when the sliding axles are received in the guide grooves 52. Therefore, as will be apparent from, e.g., a comparison between FIGS. 3 and 8, the slits of the link member 16 in the key switch 10 are smaller than the slits 102 of the link member 16 in the key switch 60.

In the assembling process of the key switch 60, when the link member 16 having the above-described configuration is to be assembled to the support plate 62, it is required to elastically deform the arms 32, 34 toward the trunk 36, around the sliding part 46 of the link member 16, so as to elastically displace a pair of sliding axles 38 toward each other by an amount sufficient to be fitted into the corresponding guide holes 66 of the guide sections 64. It is generally difficult to accurately perform the above assembling process by a manual operation, due to the reduced size of the link member 16. In particular, when a keyboard including the plural key switches 60 is to be assembled, it is desirable to use a jig for an exclusive use in assembling a multiplicity of link members 16 to a large size support plate (e.g., the support plate 62' in FIG. 23).

FIGS. 25A to 28B show an assembling jig 110 according to an embodiment of the present invention that can be used in the assembling process of the above-described key switch 60.

The assembling jig 110 includes an aligning member 114 (FIG. 25A) including a containing section 112 for containing a pair of link members 16 in a predetermined arrangement, a guiding member 118 (FIG. 25B) assembled with the aligning member 114 and including two pairs of guiding surfaces 116 individually engageable with a pair of sliding axles 38 of each of the link members 16 contained in the containing section 112, and a pressing member 122 (FIG. 27A) assembled with the guiding member 118 and including a pair of pressing sections 120 for pressing the link members 16 to the guiding member 118 in such a manner that a pair of sliding axles 38 of each link member 16 are engaged with the corresponding guiding surfaces 116 of the guiding member 118 and are thereby resiliently displaced under pressure toward each other.

Figure 25A:
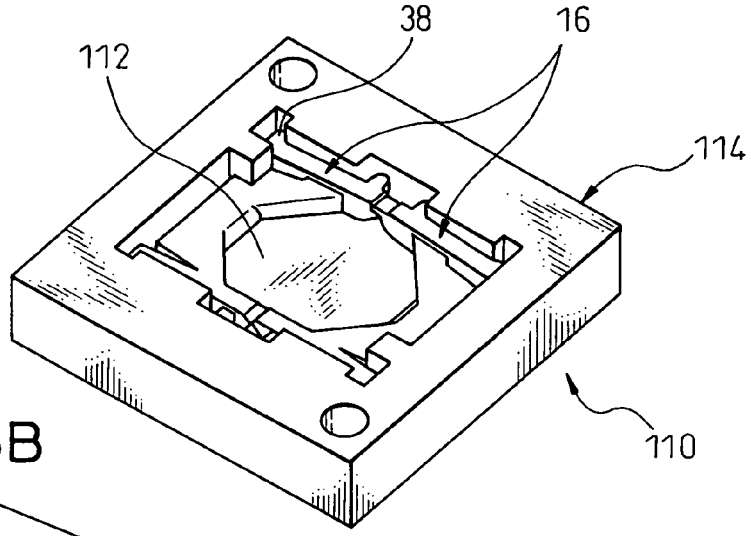
FIGS. 25A to 25C are perspective views showing an assembling jig according to an embodiment of the present invention and illustrating sequentially the steps of assembling the key switch of FIG. 6.

The aligning member 114 is a rectangular plate-like member having high rigidity and is not easily deformed by an external force. The containing section 112 of the aligning member 114 is formed as a recess having an profile capable of stably (or with substantially no fluctuation) containing a pair of link members 16 in a relative arrangement at the time of completion of the assembling process (FIG. 25A).

Figure 25B:
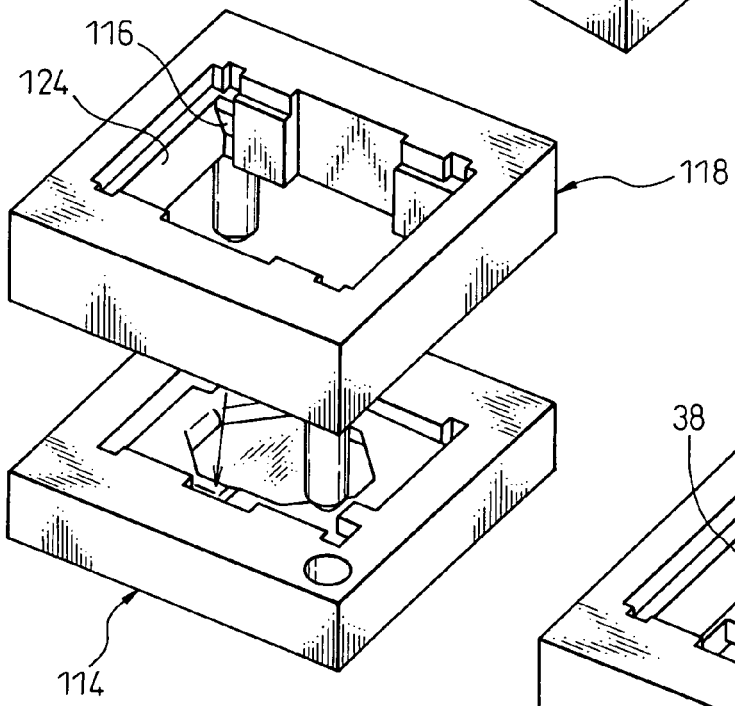
Figure 25C:
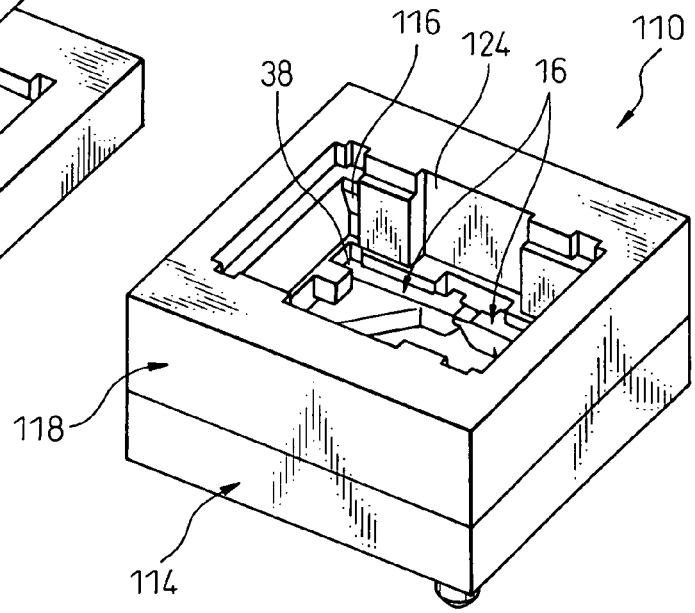

The guiding member 118 is a rectangular frame-like member having high rigidity and is not easily deformed by an external force, and is provided with a center opening 124 having an profile corresponding to the profile of the containing section 112 of the aligning member 114 (FIG. 25B). Two pairs of guiding surfaces 116 of the guiding member 118 are provided at predetermined positions respectively corresponding to the sliding axles 38 of the link members 16 contained in the containing section 112 when the guiding member 118 is properly assembled to the aligning member 114 (FIG. 25C). A pair of guiding surfaces 116 corresponding to the sliding axles 38 of one link member 16 are formed as symmetrically inclined surfaces in which the distance therebetween gradually decreases from the edges thereof adjacent to the aligning member 114 to the edges thereof away from the aligning member 114.

Figure 27A:
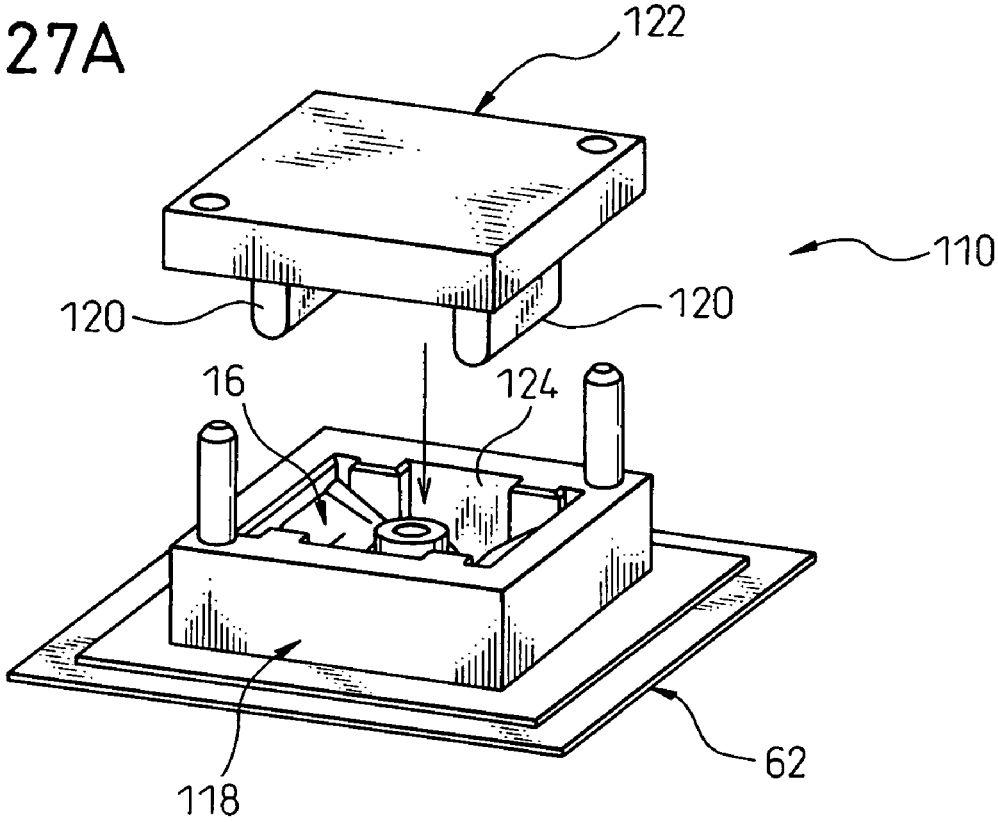
FIGS. 27A and 27B are perspective views showing the assembling jig of FIG. 25, and illustrating sequentially the assembling steps after the steps of FIG. 26B.
Figure 27B:
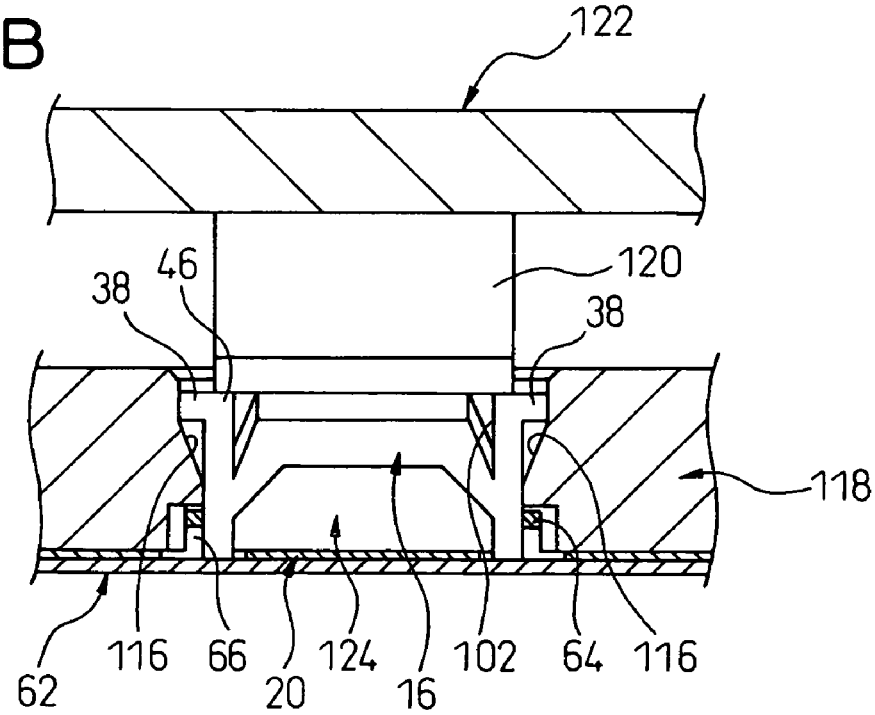

The pressing member 122 is a rectangular plate-like member having high rigidity and is not easily deformed by an external force. A pair of pressing sections 120 of the pressing member 122 are formed as wall-like protrusions that are received by the center opening 124 of the guiding member 118 when the pressing member 122 is properly assembled with the guiding member 118 (FIG. 27A). Each pressing section 120 of the pressing member 122 is abutted at the distal end thereof to the first end region including the sliding part 46 of the corresponding link member 16 disposed in the center opening 124 of the guiding member 118, and can thereby exert a pressing force on each link member 16 (FIG. 27B).

The assembling process of the key switch 60 (FIG. 6) using the assembling jig 110 will be described below.

First, the link members 16 are contained in the containing section 112 of the aligning member 114 in a relative arrangement at the time of completion of the assembling process (FIG. 25A). The guiding member 118 is accurately positioned relative to the aligning member 114 as prepared above and assembled thereto, so as to dispose each guiding surface 116 at a position corresponding to each sliding axle 38 of each link member 16 (FIG. 25C). On the other hand, a stack is provided by properly stacking the switch mechanism 20 (FIG. 6) on the support plate 62, and this stack is placed on the guiding member 118 so as to cover the center opening 124 (FIG. 26A). In this connection, two pairs of guide sections 64 of the support plate 62 (FIG. 6), projecting through the through-holes 56 of the switch mechanism 20, are received by the center opening 124 of the guiding member 118 and disposed at positions corresponding to two pairs of guiding surfaces 116.

Next, the aligning member 114 and the guiding member 118 are inverted so as to place the stack of the switch mechanism 20 and the support plate 62 underneath and, in this state, the aligning member 114 is detached from the guiding member 118 (FIG. 26B). In this state, the link members 16 are received in the center opening 124 of the guiding member 118 in a relative arrangement at the time of completion of the assembling process. Also at this time, the sliding axles 38 of each link member 16 respectively abut the vicinity of the edges of the corresponding guiding surfaces 116 of the guiding member 118, i.e., the edges between which a maximum mutual distance is defined. Each link member 16 is thereby held in the center opening 124 of the guiding member 118 in an inclined posture in which the first end region including the sliding part 46 is raised.

Figure 28A:
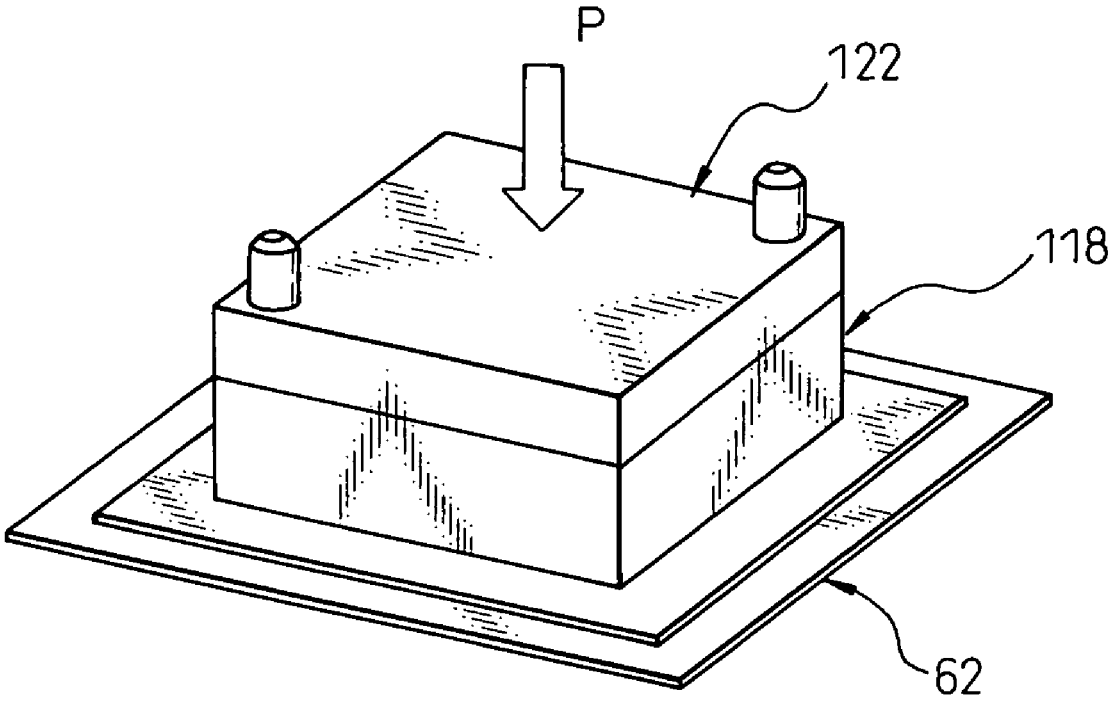
FIGS. 28A and 28B are perspective views showing the assembling jig of FIG. 25, and illustrating sequentially the assembling steps after the steps of FIG. 27B.

Next, the pressing member 122 is aligned and assembled with the guiding member 118 in such a manner that a pair of pressing sections 120 are inserted into the center opening 124 of the guiding member 118 and abutted by the ends thereof respectively to the raised first end regions of the corresponding link members 16 (FIG. 27B). At this position, a pressure P is applied to the pressing member 122 so as to force the pressing sections 120 into the center opening 124 of the guiding member 118 (FIG. 28A). The pressing force is thereby exerted from each pressing section 120 of the pressing member 122 to the first end region of the corresponding link member 16, and accordingly, a pair of sliding axles 38 of each link member 16 are slidingly engaged with the corresponding guiding surface 116 of the guiding member 118 and thus are applied with a pressure gradually increasing in accordance with the inclined shape of the guiding surface 116. As a result, due to the provision of the slit 102, the sliding axles 38 of each link member 16 are resiliently displaced toward each other (FIG. 24B).

Figure 24C:
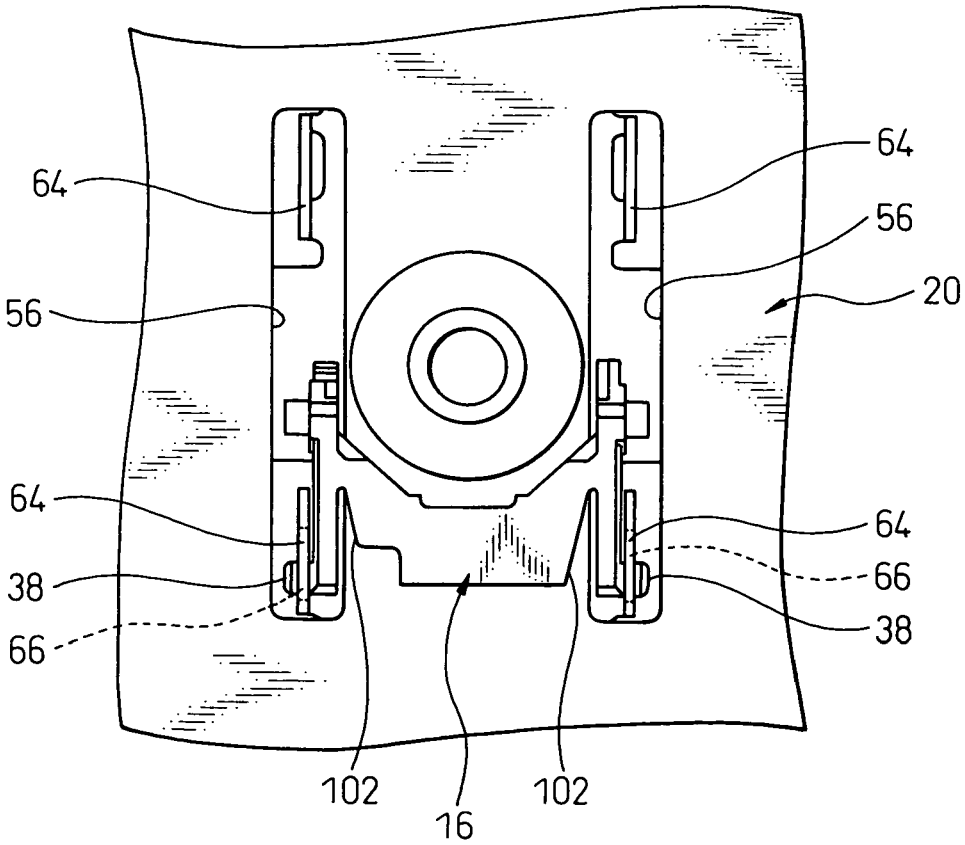
FIG. 24C is a plan view showing the link member in a state where it is assembled to a support plate.
Figure 28B:
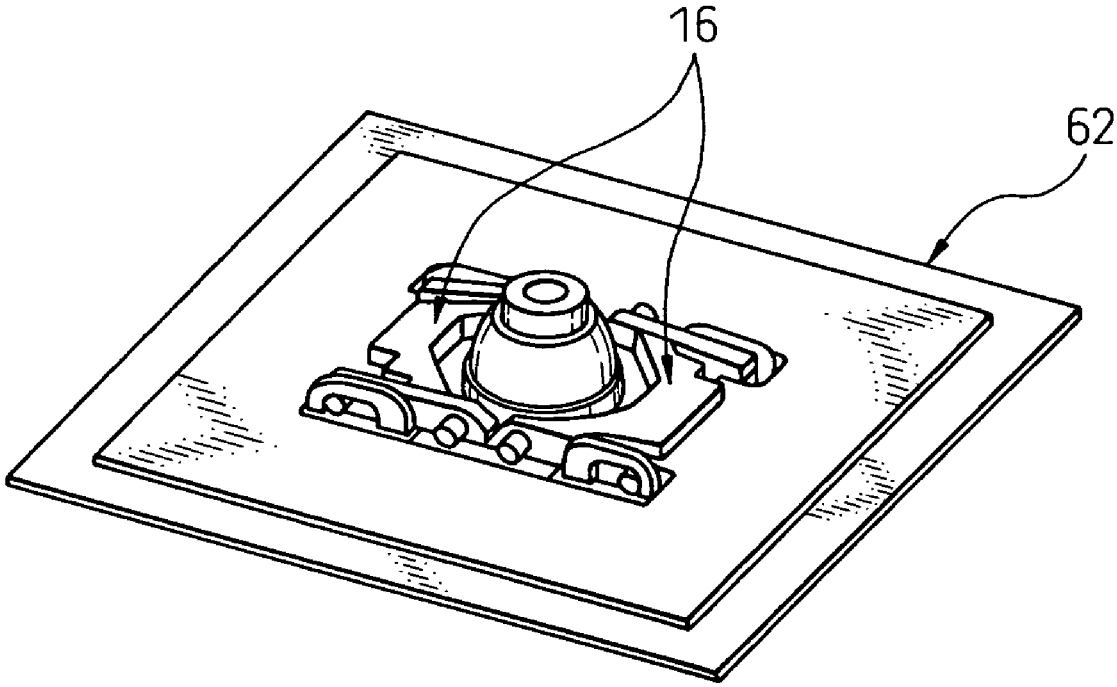
Figure 29A:
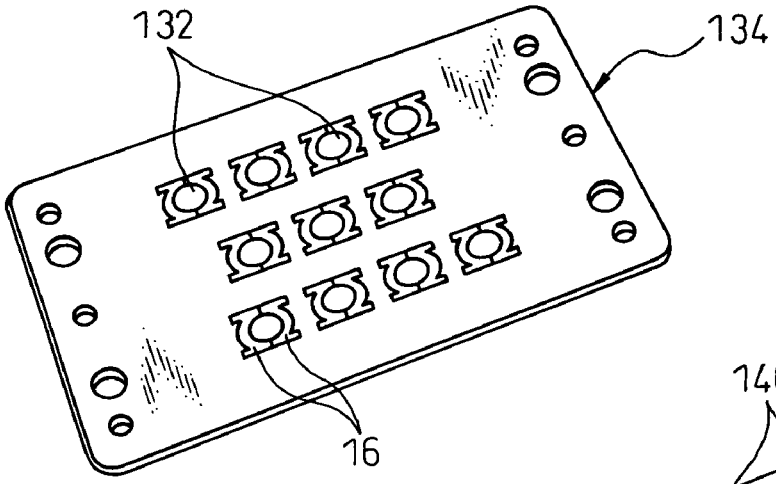
FIGS. 29A to 29C are perspective views showing an assembling jig according to another embodiment of the present invention and illustrating sequentially the steps of assembling a keyboard including the key switch of FIG. 6.
Figure 29B:
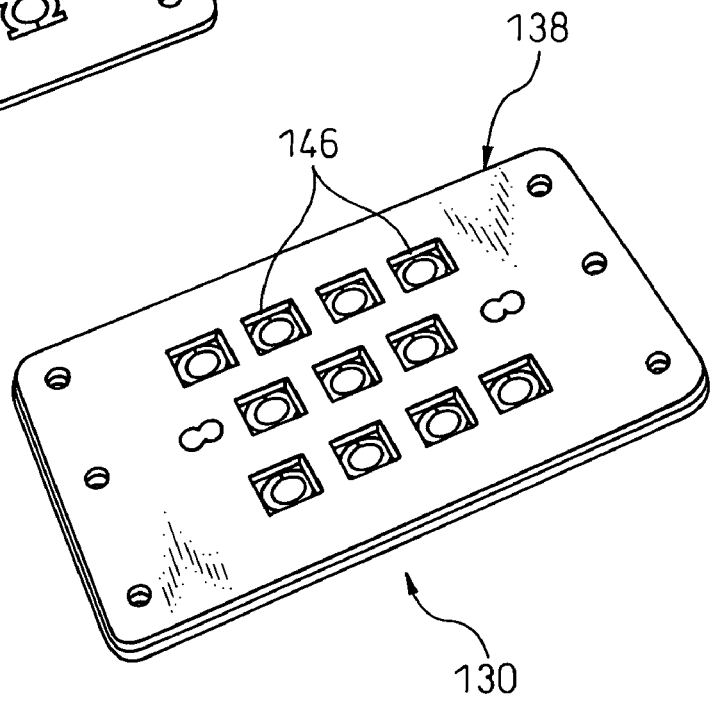
Figure 29C:
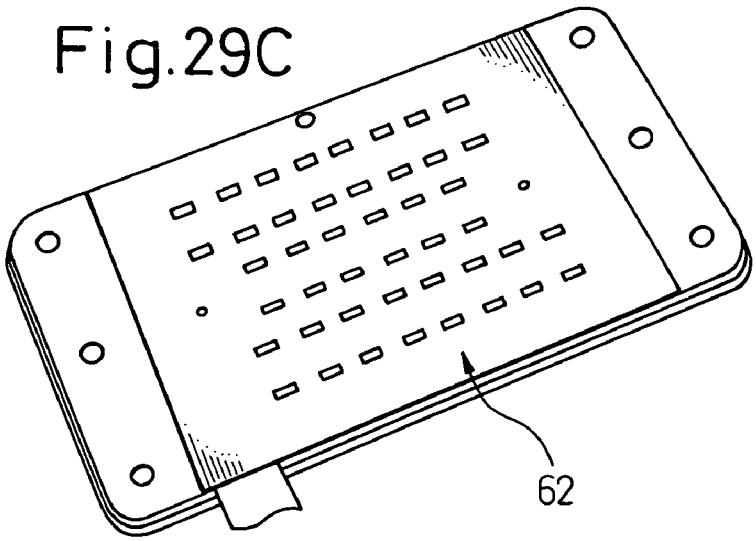

When the pressing section 120 of the pressing member 122 is forced sufficiently into the center opening 124 of the guiding member 118, the sliding axles 38 of the link member 16 slide over the guiding surface 116 of the guiding member 118, and thereby the arms 32, 34 are elastically restored (FIG. 24A). As a result, the sliding axles 38 of the link member 16 are snap-fitted into the guide holes 66 of the corresponding guide sections 64 of the support plate 62 disposed adjacent to the guiding surface 116 of the guiding member 118 (FIG. 27B). In this manner, the link members 16 are safely and accurately assembled to the support plate 62 (FIGS. 24C and 28B).

FIGS. 29A to 31B show an assembling jig 130 according to another embodiment of the present invention, which can be used in assembling a keyboard including the plural key switches 60. The assembling jig 130 includes an aligning member 134 (FIG. 29A) including a plurality of containing sections 132 for containing respectively pairs of link members 16 in predetermined arrangements, a guiding member 138 (FIG. 29B) assembled with the aligning member 134 and including a plurality of guiding surfaces 136 (FIG. 31A) individually engageable with the sliding axles 38 of the link members 16 contained respectively in the containing sections 132, and a pressing member 142 (FIG. 30A) assembled with the aligning member 134 and the guiding member 138 and including a plurality of pressing sections 140 for pressing the plural link members 16 relative to the guiding member 138 in such a manner that the sliding axles 38 of each link member 16 are engaged with the corresponding guiding surfaces 136 of the guiding member 138 and are thereby resiliently displaced under pressure toward each other.

Figure 31B:
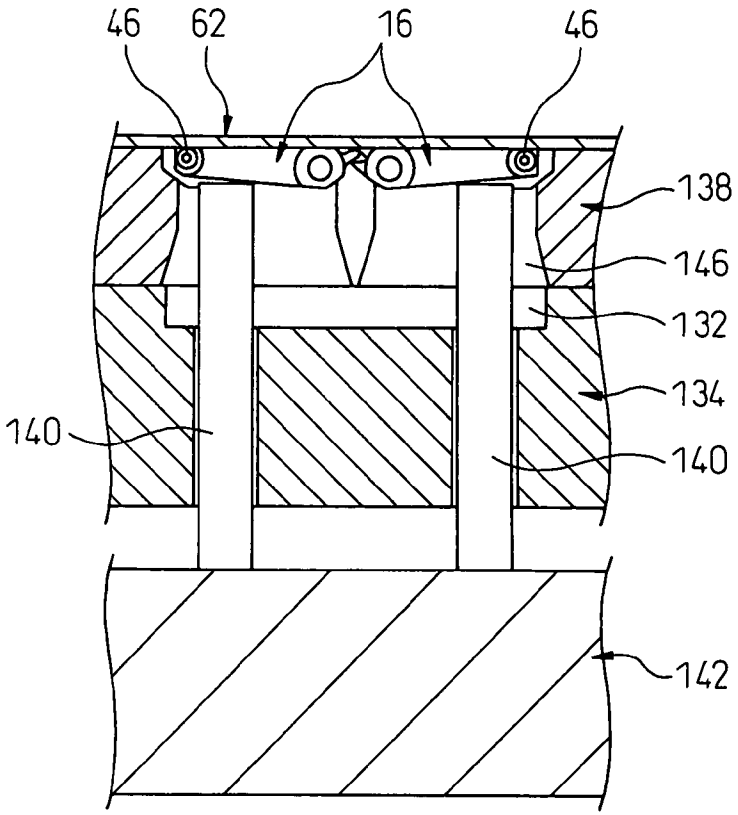
FIGS. 31A and 31B are sectional views showing the assembling jig of FIG. 29, and illustrating the assembling steps of FIGS. 30A and 30B.
Figure 31A:
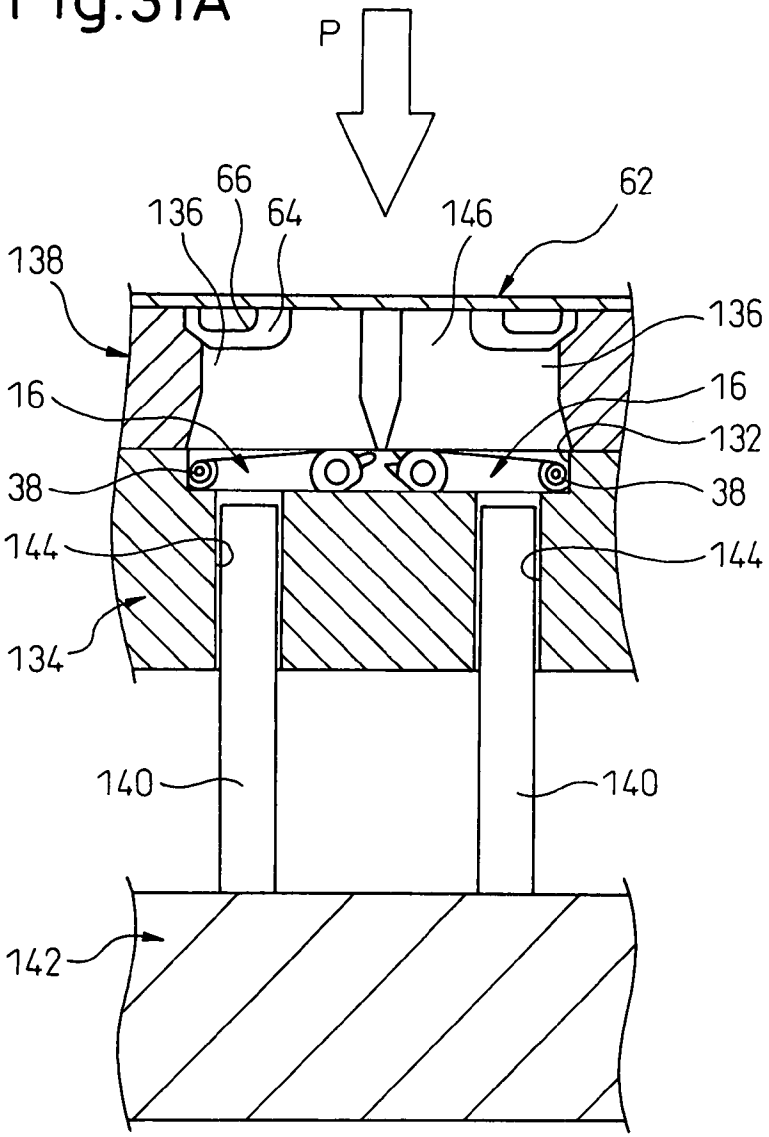

The aligning member 134 is a rectangular plate-like member having high rigidity and is not easily deformed by an external force. Each containing section 132 of the aligning member 134 is formed as a recess having an profile capable of stably (or with substantially no fluctuation) containing a pair of link members 16 in relative arrangement at the time of completion of the assembling process. In the aligning member 134, a pair of through-holes 144 are formed to be in communication with the respective containing sections 132 (FIG. 31A).

The guiding member 138 is a rectangular frame-like member having high rigidity and is not easily deformed by an external force, and is provided with a plurality of center openings 146 each having a profile corresponding to the profile of each containing section 132 of the aligning member 134. Two pairs of guiding surfaces 136 formed in each opening 146 of the guiding member 138 are provided at predetermined positions respectively corresponding to the sliding axles 38 of the link members 16 contained in the corresponding containing section 132 when the guiding member 138 is properly assembled to the aligning member 134 (FIG. 31A). Each guiding surface 136 of the guiding member 138 has an inclined surface shape similar to the guiding surface 116 of the guiding member 118 of the above-described assembling jig 110.

The pressing member 142 is a rectangular plate-like member having high rigidity and is not easily deformed by an external force. A plurality of pressing sections 140 of the pressing member 142 are pin-like elements individually received in a plurality of through-holes 144 of the aligning member 134. Each pressing section 140 of the pressing member 142 is abutted at the distal end thereof to the first end region including the sliding part 46 of the corresponding link member 16 disposed in each containing section 132 of the aligning member 134. Thereby, the pressing section 140 can exert a pressing force to each link member 16 at the first end region, and force it into each opening 146 of the guiding member 138 (FIG. 31B).

Figure 30A:
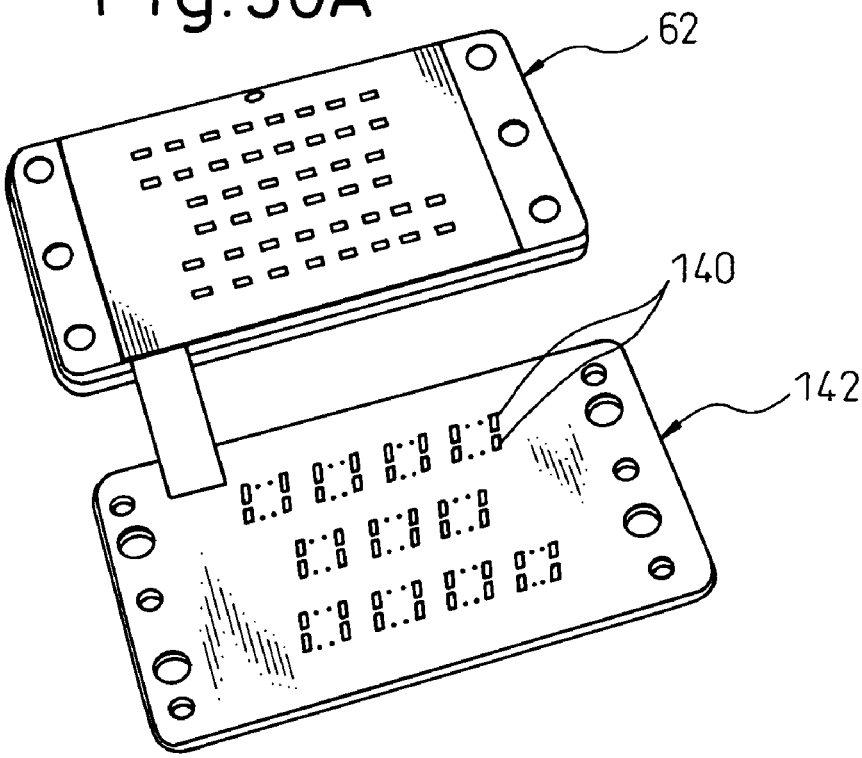
FIGS. 30A and 30B are perspective views showing the assembling jig of FIG. 29, and illustrating sequentially the assembling steps after the steps of FIG. 29C.
Figure 30B:
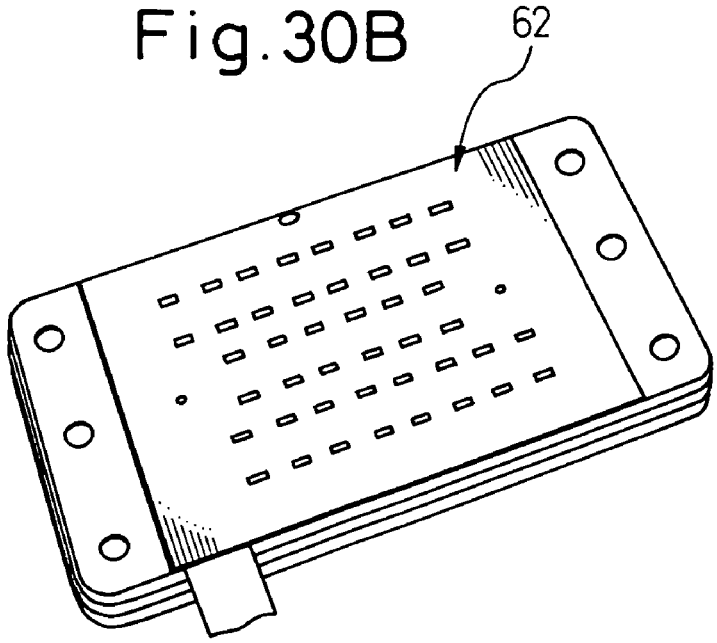

The assembling jig 130 having the above-described configuration can be used substantially in the same manner as the above-described assembling jig 110. However, after the guiding member 138 is assembled to the aligning member 134 containing plural pairs of link members 16, and a stack obtained by properly stacking the switch mechanism 20 (FIG. 6) on the support plate 62 is placed on the guiding member 138 to cover the plural openings 146 (FIG. 29C), the aligning member 134 and the guiding member 138 are not inverted. In the assembling jig 130, without detaching the aligning member 134 from the guiding member 138, the aligning member 134 is assembled with the pressing member 142 with the support plate 62 placed thereon (FIG. 30B). Then, a pressure P is applied to the support plate 62 in such a manner that the pressing section 140 of the pressing member 142 is forced into the containing section 132 of the aligning member 134 and the opening 146 of the guiding member 138 (FIG. 31A). As a result, the sliding axles 38 of each link member 16 are subjected to pressure from the corresponding guiding surfaces 136 of the guiding member 138 so as to be resiliently displaced toward each other, and are finally snap-fitted into the guide holes 66 of the corresponding guide sections 64 of the support plate 62. In this manner, the plural pairs of link members 16 are simultaneously assembled to the support plate 62 safely and accurately (FIG. 31B).

The present invention is not limited to the above-described illustrated embodiment, but various modifications may be made thereto. For example, the configuration of a key switch of the present invention, in which the sliding part of the link member passes through the through-hole in the membrane switch sheet and thus is placed on the support plate, is applicable not only to the gear link type link member as in the illustrated embodiment, but also applicable to a key switch having other types of link members, such as pantograph type link members.

While the invention has been described with reference to specific preferred embodiments, it will be understood, by those skilled in the art, that various changes and modifications may be made thereto without departing from the spirit and scope of the following claims.

The invention claimed is:

1. A key switch comprising:

a support plate;

a key top arranged above said support plate;

a pair of link members interlocked to each other to support said key top above said support plate and direct said key top in a vertical direction; and a switch mechanism capable of opening and closing a contact section of an electric circuit in accordance with a vertical movement of said key top;

wherein said switch mechanism includes a membrane switch sheet carrying said contact section at a position corresponding to said key top and placed on said support plate;

wherein each of said pair of link members includes a sliding part slidably engaged with said support plate; and wherein said membrane switch sheet is provided with a through-hole in a region where said sliding part of each link member is engaged with said support plate, said sliding part of said link member being slidably placed on said support plate through said through-hole in said membrane switch sheet.

2. A key switch as set forth in claim 1, wherein each of said pair of link members includes a trunk extending from said sliding part and provided with a recess capable of receiving said membrane switch sheet; and wherein, when said key top is located at a lowermost position of said vertical movement, said sliding part is in contact with said support plate through said through-hole of said membrane switch sheet and said trunk is disposed to be superimposed on said membrane switch sheet at said recess.

3. A key switch as set forth in claim 1, wherein each of said pair of link members includes an arm extending from said sliding part; and wherein, when said key top is located at a lowermost position of said vertical movement, said sliding part and said arm are in contact with said support plate through said through-hole of said membrane switch sheet.

4. A key switch as set forth in claim 1, wherein said support plate includes a guide section for guiding said sliding part of each of said pair of link members during said vertical movement of said key top, said guide section projecting through said through-hole of said membrane switch sheet upward from said membrane switch sheet.

5. A key switch as set forth in claim 4, wherein said support plate is formed from a sheet metal material; and wherein said guide section is integrally formed at a desired location on said support plate by a lancing process.

6. A key switch as set forth in claim 4, wherein said support plate is formed from a resinous material; and wherein said guide section is integrally molded at a desired location on said support plate.

7. A key switch as set forth in claim 6, wherein said support plate is formed from an electro-conductive resinous material.

8. A key switch as set forth in claim 4, wherein said sliding part of each of said pair of link members includes a pair of sliding axles projecting oppositely to each other; wherein said guide section of said support plate includes two pairs of guide holes individually and slidably receiving said pair of sliding axles of said pair of link members; and wherein each of said pair of link members further includes a slit for permitting said pair of sliding axles to be resiliently displaced toward each other by an amount sufficient for said pair of sliding axles to be fitted into a corresponding pair of said guide holes.

9. A key switch as set forth in claim 1, further comprising a base panel disposed above said membrane switch sheet; wherein said base panel includes a guide section for guiding said sliding part of each of said pair of link members during said vertical movement of said key top.

10. An assembling jig for use in an assembling process of a key switch as set forth in claim 8, comprising:

an aligning member including a containing section for containing a pair of link members in a predetermined arrangement;

a guiding member assembled with said aligning member and including a guiding surface capable of engaging with said pair of sliding axles of each of said pair of link members contained in said containing section; and a pressing member assembled with one of said aligning member and said guiding member and including a pressing section for pressing each of said pair of link members relative to said guiding member in such a manner that said pair of sliding axles of each of said pair of link members are engaged with said guiding surface of said guiding member and are thereby resiliently displaced under pressure toward each other.

11. A keyboard comprising a plurality of key switches in a certain arrangement, each of said key switches being as described in claim 1.

12. A keyboard comprising:

a plurality of key switches, each key switch including a key top adapted to be subjected to a key-entry operation; and a frame including a front edge defining an operator's side during said key-entry operation and a rear edge opposite to said front edge, said plurality of key switches being arranged in said frame;

wherein said key top of each of said plurality of key switches includes an operating surface adapted to be subjected to said key-entry operation and a skirt surface depending from said operating surface along an outer edge of said operating surface, said operating surface being provided with a first profile as a substantially equilateral trapezoid in a plan view, said skirt surface being provided, at its bottom edge away from said operating surface, with a second profile as a substantially rectangular shape in a plan view; and wherein said plurality of key switches are arranged in said frame with said operating surface of said key top of each key switch being disposed in such a manner that a shorter side of generally parallel opposing sides defining said first profile is positioned nearer to said front edge of said frame and a longer side of said opposing sides is positioned nearer to said rear edge of said frame.

* * * * *